US006830311B2

(12) United States Patent
Fukasawa et al.

(10) Patent No.: US 6,830,311 B2
(45) Date of Patent: Dec. 14, 2004

(54) INK JET RECORDING APPARATUS, MOVING POSITION CONTROL METHOD OF CAPPING DEVICE THEREIN, AND FLUSHING CONTROL METHOD THEREFOR

(75) Inventors: Shigenori Fukasawa, Nagano (JP); Atsushi Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/068,007

(22) Filed: Feb. 8, 2002

(65) Prior Publication Data

US 2002/0118247 A1 Aug. 29, 2002

(30) Foreign Application Priority Data

| | | |
|---|---|---|
| Feb. 9, 2001 | (JP) | P2001-033418 |
| Mar. 15, 2001 | (JP) | P2001-073469 |
| Jan. 10, 2002 | (JP) | P2002-003408 |

(51) Int. Cl.[7] ..... B41J 2/165

(52) U.S. Cl. ..... 347/29; 347/33; 347/37; 347/23; 400/55

(58) Field of Search ..... 347/29, 14, 23, 347/30, 32, 33, 35, 22, 8; 400/55, 59

(56) References Cited

U.S. PATENT DOCUMENTS 6,315,468 B2 * 11/2001 Kishida et al. ..... 400/55

FOREIGN PATENT DOCUMENTS

| | | |
|---|---|---|
| JP | 2-204042 A | 8/1990 |
| JP | 10-100450 A | 4/1998 |
| JP | 10-211748 | 8/1998 |
| JP | 11-115275 | 4/1999 |

OTHER PUBLICATIONS

Patent Abstracts of Japan 10–100450, Apr. 21, 1998.

Patent Abstracts of Japan 02–204042, Aug. 14, 1990.

* cited by examiner

*Primary Examiner*—Shih-Wen Hsieh
(74) *Attorney, Agent, or Firm*—Sughrue Mion, PLLC

(57) ABSTRACT

A cap holder on which a cap member is formed is mounted on a slider which constitutes a capping device. This slider is driven along vertical direction by receiving driving force executed by moving a carriage, so that an interval between the cap member and a nozzle forming surface of a recording head is adjusted. As a result, since a stopping position of the carriage is controlled in response to an adjustment amount of a platen gap, a distance between the recording head and the capping device when a flushing operation is carried out can be controlled under proper condition. Also, even when the control operation is advanced to a capping condition, the capping device can cap the nozzle forming surface under proper pressure.

18 Claims, 11 Drawing Sheets

INK JET RECORDING APPARATUS, MOVING POSITION CONTROL METHOD OF CAPPING DEVICE THEREIN, AND FLUSHING CONTROL METHOD THEREFOR

BACKGROUND OF THE INVENTION

The present invention is related to an ink jet recording apparatus operated in such a manner that a moving position of a capping device is changed during both flushing operation and capping operation in accordance with an adjusting amount of a platen gap by a platen gap adjuster, and is also related to a moving position control method of the capping device, and is further related to a flushing control method used in an ink jet recording apparatus operated in such a manner that a flushing operation mode is changed in accordance with an adjusting amount of a platen gap.

For instance, an ink jet recording apparatus of a serial printing system is equipped with an ink jet recording head, and a paper feeding means. While the ink jet recording head is mounted on a carriage, this ink jet recording head is transported along a main scanning direction. The paper feeding means feeds recording paper sheets along a sub-scanning direction located perpendicular to the above-described main scanning direction. Since ink droplets are jetted from the recording head in accordance with print data, a printing operation is carried out with respect to the recording paper sheets.

The above-described ink jet recording head owns the below-mentioned problem in connection with such a printing operation that ink which is pressured in a pressure producing chamber is jetted as ink droplets from nozzle openings onto recording paper sheets. That is to say, the ink viscosity is increased due to evaporation of ink solvent from the nozzle openings, the ink is caked, and dust is attached to the nozzle openings, so that the normal jetting operation of the ink droplets from the nozzle openings is disturbed, resulting in an occurrence of a printing failure.

To avoid this problem, this sort of ink jet recording apparatus are equipped with capping device capable of capping, or sealing nozzle forming surfaces of recording heads while printing operations thereof are set under rest conditions. This capping device may have not only a function of a lid, but also a jetting function recovering means of ink droplets. This lid function is capable of preventing ink of the nozzle openings in the recording head from being dried. The ink droplets jetting function recovering means is capable of solving clogging of the nozzle openings in the case that the ink clogs the nozzle openings in such a manner that the nozzle forming surfaces are capped, and negative pressure is applied from a suction pump so as to suck/eject the ink from the clogging nozzle openings. As a result, clogging problems of the nozzle opening can be solved.

A process operation for forcibly sucking/ejecting ink in order to solve clogging of a recording head is generally referred to as a cleaning operation. This cleaning operation is carried out in the case that a printing operation is restarted after a long rest condition of a recording apparatus, and/or in the case that a user recognizes a printing failure and thus manipulates, for example, a cleaning switch. Then, as previously explained, after the negative pressure is applied by operating the suction pump and the ink is sucked/ejected from the recording head into the capping device, the nozzle forming surfaces are wiped by way of a wiping means which is formed by using, for instance, a rubber material and the like.

On the other hand, the above-described capping device is also equipped with a recovery means of such an ink droplet jetting function, which is provided independent from the above-explained cleaning operation. This ink droplet jetting function may flush ink droplets by applying such a drive signal to the recording head irrespective of printing operation. This recovery means is called as a flushing operation, this flushing operation is carried out every time a constant time period has elapsed in order to achieve an object capable of avoiding such a problem that clogging can be prevented, while this clogging effect occurs due to an increase in viscosity of ink located in nozzle openings from which a few amount of ink droplets is jetted while printing operation is carried out.

On the other hand, most of this sorts of recording apparatus are constructed in such a manner that the ink droplets jetted by the above-explained flushing operation are received by the above-described capping device. In this case, the following problem will occur when an interval between the nozzle forming surface of the recording head and the capping device is extremely narrow. That is, ink droplets jetted from the nozzle openings are rebounded within the capping device, and a portion of these rebounded ink droplets is again flied to the nozzle openings. As a result, meniscus of ink formed in a nozzle opening is destroyed, and thus, the normal jetting effect of the ink droplets from this nozzle opening is disturbed, so that such a printing failure called as "dot skipping" may occur.

Also, in such a case that an interval between the nozzle forming surface of the recording head and the capping device is wide, an occurrence of ink mist may be induced. In this ink mist, ink droplets jetted from the recording head receive air resistance and the like, so that these ink droplets are further distributed in the form of very small ink droplets, and these very small ink droplets are changed under mist state. When such ink mist is produced, various damages are given to the above sort of recording apparatus. That is, while the ink mist may float within the recording apparatus, this floating ink mist not only contaminates recording paper sheets, but also are attached to the respective drive mechanisms and printed circuit boards employed in the recording apparatus and thereafter are caked thereon. As a consequence, when the flushing operation is carried out, the above-described interval between the nozzle forming surface and the capping device should be properly controlled.

On the other hand, in this sort of recording apparatus, a platen gap adjuster is provided. This platen gap adjuster is capable of adjusting a platen gap between the recording head and the platen in correspondence with a thickness of a recording paper sheet. Then, the platen gap adjusters are generally constructed as follows. That is, when the platen gap adjuster is manipulated, the position of the recording head may be changed with respect to the platen which is arranged on a fixed position. As a result, in the case that the platen gap is adjusted, the above-described distance between the nozzle forming surface and the capping device is changed.

More specifically, nowadays, since various printing needs are made, considerably thick paper sheets are required to be used as printing paper sheets. In accordance with such a requirement, the gap adjustable range by the above-explained platen gap adjuster should be necessarily and considerably increased, as compared with the gap adjustable range of the prior art. As a consequence, the move amount of the recording head with respect to the platen is accordingly increased by manipulating the platen gap adjuster. Since such a move amount is increased, the increased move amount extremely exceeds the proper interval range between the nozzle forming surface of the recording head and the capping device, which may induce the above-described printing failure such as dot skipping, or may induce the mechanical trouble and the electrical trouble, which are caused by the occurrence of the above-described ink mist.

Also, as described above, since the platen gap is changed, the positional relationship between the nozzle forming surface of the recording head and the capping device for capping the nozzle forming surface, so that abutting pressure of the capping device with respect to the nozzle forming surface is changed. As a consequence, for instance, in such a case that the abutting pressure of the capping device with respect to the nozzle forming surface is brought into over-pressure condition, another problem occurs. That is, the capping member which abuts on the nozzle forming surface is deformed. Then, in the case that the platen gap is again adjusted, and thus, the abutting pressure of the capping device with respect to the nozzle forming surface is lowered, a further problem will occur. That is, the above-explained deformation of the capping member may cause such a condition that appropriate capping (sealing) conditions cannot be established.

SUMMARY OF THE INVENTION

A recording apparatus, according to a first aspect of the present invention, has been made to solve the above-described problems. A first object of the present invention is therefore to provide an ink jet recording apparatus, and a moving position control method of a capping device employed in this ink jet recording apparatus, while such an ink jet recording apparatus is capable of adjusting positions of the capping device at both a flushing position and a capping position in correspondence with a change in platen gaps, so that both a proper flushing operation and proper capping pressure can be obtained.

Also, a recording apparatus, according to a second aspect of the present invention, has also been made to solve the above-described problems. A second object of the present invention is therefore to provide an ink jet recording apparatus, and a flushing control method for this ink jet recording apparatus, while this ink jet recording apparatus is capable of lowering an occurrence of printing failure such as the above-described dot skipping, or lowering occurrence degrees of mechanical troubles and electrical troubles caused by ink mist.

To achieve the above-described first object, the ink jet recording apparatus, according to the first aspect of the present invention, is featured by such an ink jet recording apparatus comprising: an ink jet recording head mounted on a carriage for jetting ink droplets in accordance with print data; and a capping device for capping a nozzle forming surface of the recording head; wherein when the carriage is moved to a mount portion where the capping device is mounted, the capping device is moved toward the nozzle forming surface of the recording head by receiving a driving force which moves the carriage, so that the capping device caps the nozzle forming surface; and a stopping position of the carriage in the mount portion of the capping device is adjusted based on adjustment information of a platen gap adjuster.

In this case, the capping device preferably includes a slider which is moved toward the recording head by receiving at least the driving force which moves the carriage, and a cap member mounted on the slider for capping the nozzle forming surface of the recording head, wherein when the carriage is moved, the driving force which moves the carriage is transmitted from a side of the carriage to a side of the slider through a driving force transmitting device which abuts against the slider.

Also, the slider is constructed in such a manner that the slider is moved toward the recording head being attached to a link arm rotatably mounted on a frame by receiving the driving force of the carriage through the driving force transmitting device; and a guide projection formed on the slider is slid along a guide groove formed in the frame in an inclined manner, whereby the slider is moved toward the recording head.

In this case, preferably, the ink jet recording apparatus comprises further a regulating device for retaining the guide projection formed on the slider at a predetermined position in the guide groove based on the adjustment information of the platen gap adjuster. Then, the ink jet recording apparatus is constituted in such a manner that a flushing position where the capping device is located opposite to the nozzle forming surface of the recording head with a predetermined interval and a capping position where a nozzle forming surface of the recording head is capped by the capping device, are set based on adjustment information of the platen gap adjuster.

Then, in a preferable embodiment, in the case that the adjustment information of the platen gap adjuster indicates that a platen gap is small, the guide projection formed on the slider is regulated to be retained at a lower position within the guide groove formed in the frame under inclined condition at each of the flushing position and the capping position, as compared with such a case that the adjustment information of the platen gap adjuster indicates that a platen gap is large.

Also, the ink jet recording apparatus may be arranged in such a manner that the regulating operation for retaining the guide projection at a predetermined position in the guide groove is performed by stopping a drive operation of a carriage motor for moving the carriage in the reciprocation motion.

Then, a spring member is interposed between the slider and the cap member; and the cap member abuts against the nozzle forming surface of the recording head by receiving urging force exerted by the spring member under such a condition that the nozzle forming surface of the recording head is capped by the capping device, the ink jet recording apparatus is arranged in such a manner that the regulating operation for retaining the guide projection at a predetermined position in the guide groove is performed by stopping a drive operation of a carriage motor for moving the carriage in the reciprocation motion On the other hand, a moving position control method of a capping device, according to another aspect of the present invention, is featured by that in a moving position control method of a capping device employed in an ink jet recording apparatus comprising: an ink jet recording head mounted on a carriage transported in a reciprocation motion, for jetting ink droplets in accordance with print data; and capping device capable of capping a nozzle forming surface of the recording head; in which when the carriage is moved to a mount portion of the capping device, the capping device is moved toward the nozzle forming surface of the recording head by receiving driving force of the carriage, the moving position control method sequentially executes: a flushing requirement judging step for judging as to whether or not the flushing operation is required; a platen gap adjustment information acquiring step for acquiring adjustment information of a platen gap adjuster in such a case that the flushing requirement judging step judges that the flushing operation is required; an interval adjusting step for controlling the moving position of the carriage to a mount portion of the capping device based upon the platen gap adjustment information acquired at the platen gap adjustment information acquiring step so as to adjust an interval between the nozzle forming surface of the recording head and the capping device at a flushing position; and a flushing step for flushing ink droplets from the recording head into the capping device, while maintaining the interval adjusted by the interval adjusting step.

In this case, the moving position control method is advanced to the flushing requirement judging step is carried out based upon a time counting operation of a flushing timer which is managed while print operation of the recording apparatus is carried out.

Moreover, a moving position control method of a capping device, according to another preferred embodiment of the present invention, is featured by that in a moving position control method of a capping device employed in an ink jet recording apparatus comprising: an ink jet recording head mounted on a carriage transported in a reciprocation motion, for jetting ink droplets in accordance with print data; and capping device capable of capping a nozzle forming surface of the recording head; in which when the carriage is moved to a mount portion of the capping device, the capping device is moved toward the nozzle forming surface of the recording head by receiving driving force of the carriage, the moving position control method sequentially executes: a capping requirement judging step for judging as to whether or not the ink jet recording head is required to be advanced to a capping condition; a platen gap adjustment information acquiring step for acquiring adjustment information of a platen gap adjuster in such a case that the capping requirement judging step judges that the capping operation is required; and a carriage move control step for controlling the moving position of the carriage to a mount portion of the capping device based upon the platen gap adjustment information acquired in the platen gap adjustment information acquiring step.

In accordance with the recording apparatus of the first embodiment of the present invention with employment of the above-described moving position control method of the capping device, while the gap adjustment information acquired from the platen gap adjuster is utilized, the drive control of the carriage motor is carried out, and this carriage motor drives the carriage in the reciprocation motion based upon this gap adjustment information. On the other hand, the capping device is provided with the slider which is moved toward the nozzle forming surface of the recording head by receiving the driving force of the carriage. Since the cap member capable of capping the nozzle forming surface is arranged on this slider, the positional relationship between the nozzle forming surface of the recording head and the capping device can be controlled in response to the stopping position of the carriage under drive control by the carriage motor.

As a consequence, in the case that the capping device is located at the flushing position opposite to the capping device by maintaining a predetermined interval between the capping device and the nozzle forming surface of the recording head, the interval between both these members can be controlled under proper condition based upon the gap adjustment information. As a result, as previously explained, it is possible to solve such a problem that since the interval between both the members is brought into improper condition, the print failure occurs and the ink mist occurs.

Also, even in such a case that the control operation is advanced to the capping condition under which the nozzle forming surface of the recording head is capped by the capping device, the stopping position of the carriage is adjusted based upon the above-described cap adjustment information. As a result, the position of the cap member arranged on the slider can be adjusted. Therefore, the abutting pressure of the capping device capable of capping the nozzle forming surface can be controlled to the proper pressure condition.

Also, an ink jet recording apparatus according to a second embodiment of the present invention, which is accomplished so as to achieve the above-described second object, is featured by such an ink jet recording apparatus comprising: an ink jet recording head mounted on a carriage transported in a reciprocation motion, for jetting ink droplets in accordance with print data; and flushing control unit for moving the recording head to a flushing area and for applying a drive signal irrespective of a printing operation to the recording head so as to flush ink droplets into the flushing area; wherein: while a flushing operation is carried out in the flushing area, the flushing control unit adjusts an ink jetting amount of one dot during the flushing operation based upon adjustment information of a platen gap adjuster.

In this case, preferably, in the case that the adjustment information of the platen gap adjuster indicates that a platen gap is large, the flushing control unit increases the ink amount of one dot, which is jetted while the flushing operation is carried out, as compared with that of such a case that the adjustment information of the platen gap adjuster indicates that the platen gap is small.

Furthermore, preferably, in the case that the adjustment information of the platen gap adjuster indicates that a platen gap is large, the flushing control unit decreases a total number of ink droplets which are jetted from the recording head while a single flushing step is carried out, as compared with that of such a case that the adjustment information of the platen gap adjuster indicates that the platen gap is small.

Then, in the preferable embodiment, the ink droplets jetted from the recording head by executing the flushing operation are received by capping a nozzle forming surface of the recording head.

On the other hand, a flushing control method, according to a further aspect of the present invention, is featured by that in a flushing control method executed in an ink jet recording apparatus comprising: an ink jet recording head mounted on a carriage transported in a reciprocation motion, for jetting ink droplets in accordance with print data; and flushing control unit for moving the recording head to a flushing area and for applying a drive signal irrespective of a printing operation to the recording head so as to flush ink droplets into the flushing area;

the flushing control method sequentially executes: a flushing requirement judging step for judging as to whether or not the flushing operation is required; an ink amount setting step for setting an ink jetting amount of one dot during a flushing operation based upon platen gap adjustment information in such a case that the flushing requirement judging step judges that the flushing operation is required; and a flushing step for flushing ink droplets with respect to a flushing area based upon the ink jetting amount of one dot which is set in the ink amount setting step.

In this case, in the case that the ink jetting amount of one dot during the flushing operation is set in the ink amount setting step, a total number of ink droplets which are jetted from the recording head within a single flushing step is set at the same time.

In addition, in the flushing control method according to the present invention, the flushing requirement judging step is carried out based upon a time counting operation of a flushing timer which is managed while print operation of the recording apparatus is carried out.

In accordance with the recording apparatus of the second embodiment with employment of the above-described flushing control method, while the flushing operation is carried out, the gap adjustment information derived from the platen gap adjustment means is utilized, and also, the ink jetting amount of one dot during the flushing operation is controlled to be adjusted based upon this gap adjustment information. For instance, in such a case that the platen gap is adjusted to be large, the ink jetting amount of one dot is controlled to be increased, as compared with that of such a case that the platen gap is adjusted to be small.

As explained above, in the case that the platen gap is adjusted to be large, since such a control operation is performed so as to increase the ink jetting amount of one dot, even when the jetting distance of the ink droplets is long, the occurrence degree of the ink mist can be suppressed. On the other hand, in this case, since the distance between the nozzle forming surface of the recording head and the impinge positions of the ink droplets is long, such a degree that the ink droplets are rebounded at the impinge positions and then a portion of these rebounded ink droplets is again flied to the nozzle opening can be considerably reduced. Thus, the occurrence of such a print failure, for instance, dot skipping can be suppressed.

Furthermore, in the case that the platen gap is large, such a control operation is carried out. That is, a total number of ink droplets which are jetted from the recording head in a single flushing step may be decreased. As a result, the jetting amount of the ink within a single flushing step may be controlled to a substantially constant range. As a consequence, the recording apparatus can realize the purpose of the flushing operation, and also can suppress the consumption of such ink.

DETAILED DESCRIPTION OF THE PREFERRED EMBODIMENTS

Figure 1:
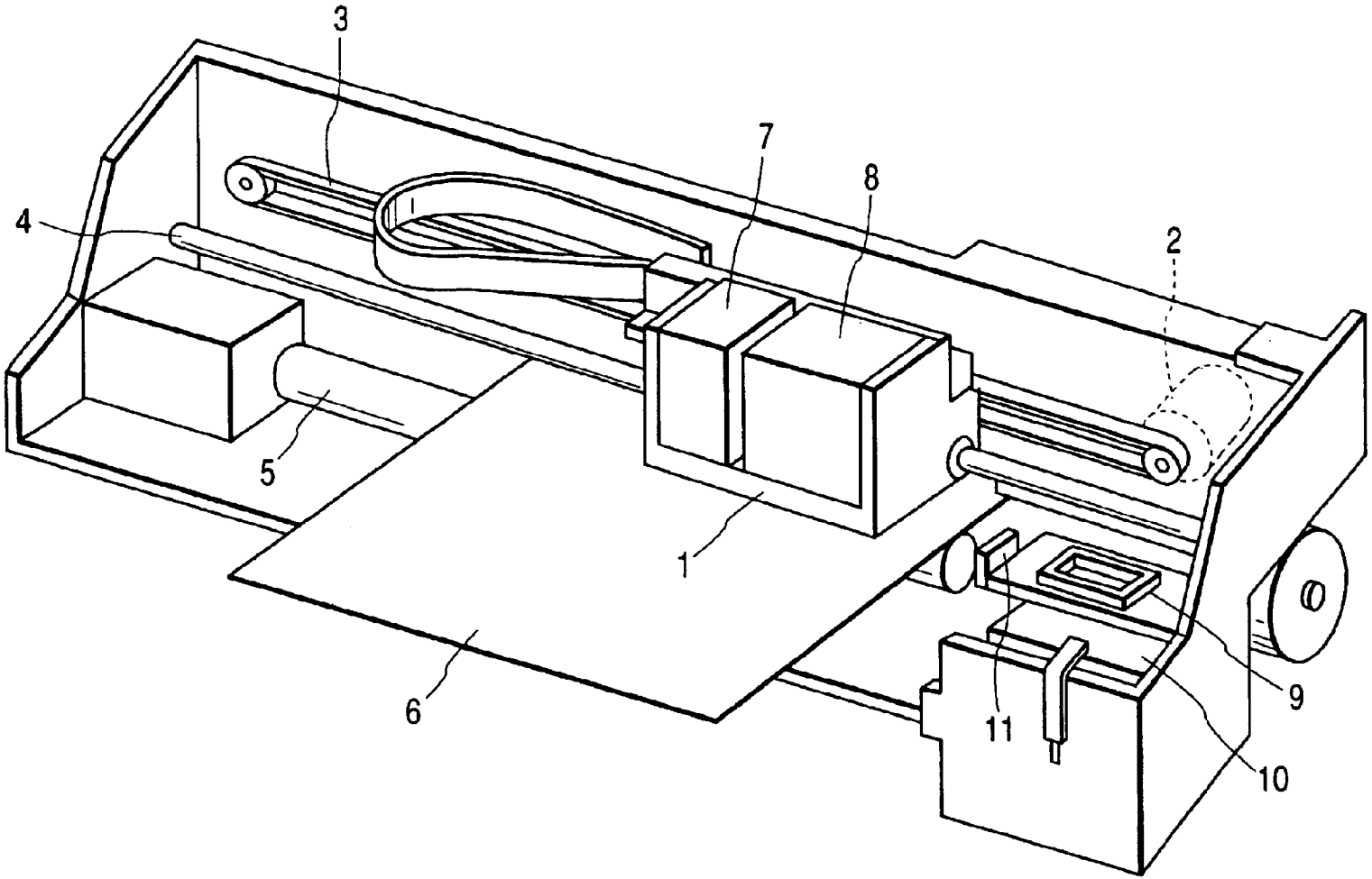
FIG. 1 is a perspective view for indicating a basic construction of an ink jet recording apparatus to which the present invention is applied.

Next, a description will now be made of an ink jet recording apparatus according to the present invention based upon embodiments shown in drawings. FIG. 1 indicates a basic structure of an ink jet recording apparatus according to a first embodiment and a second embodiment, to which the present invention has been applied. In FIG. 1, reference numeral 1 shows a carriage. This carriage 1 is constructed in such a manner that the carriage 1 is transported in a reciprocating motion manner through a timing belt 3 driven by a carriage motor 2, while being guided by a guide member 4. As will be explained later, an ink jet recording head is mounted on a surface (namely, lower side surface) of the above-described carriage 1, which is located opposite to a recording paper sheet 6. Also, both a black ink cartridge 7 and a color ink cartridge 8, which supply ink to the above-explained recording head, are detachably mounted on an upper portion of this carriage 1.

In this drawing, reference number 9 shows a capping device which is arranged in a non-printing area (namely, home position). The capping device 9 is arranged in such a manner that when the recording head mounted on the carriage 1 is transported in an upright direction, this capping device 9 is lifted up, by which a nozzle forming surface of the recording head can be capped, or sealed. Then, a suction pump 10 is arranged under the capping device 9, while this suction pump 10 applies negative pressure to an internal space of this capping device 9.

The capping device 9 may function as a lid, and a cleaning means. This lid is capable of avoiding such a condition that the nozzle head are dried during rest time period of the ink-jetting type recording apparatus. In this cleaning means, while the negative pressure obtained from the suction pump 10 is effected to the recording head, ink is sucked from the recording head so as to be ejected. Furthermore, this capping device 9 may own another function as an ink receiver while a flushing operation is carried out. In this flushing operation, such a drive signal irrespective of a printing operation is applied to the recording head in order to flush ink droplets.

Then, a wiping member 11 in which a rubber material is formed in a rectangular shape is arranged adjacent to the printing area side of the capping device 9 in such a manner that this wiping member 11 can be slid along the horizontal direction. While the carriage 1 is moved in the reciprocating motion manner on the side of the capping device 9, this wiping member 11 can wipe the nozzle forming surface of the recording head, if necessary. As a result, for instance, this wiping member 11 can wipe such ink attached, or adhered on the nozzle forming surface after the cleaning operation, so that this wiping member 11 can prevent recording paper sheets and the like from being contaminated, since large amounts of ink droplets are mistakenly dropped from the recording head.

Figure 2:
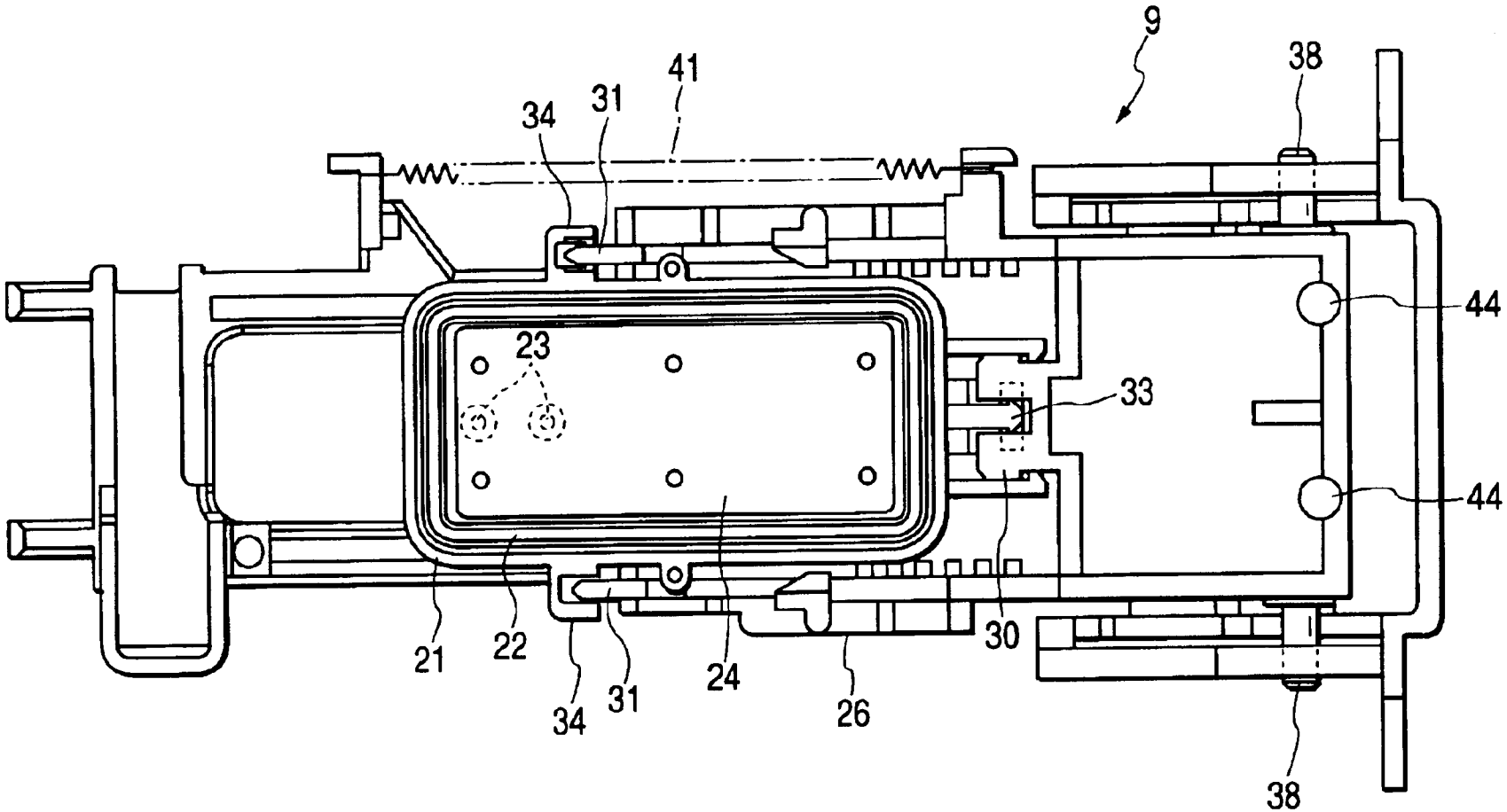
FIG. 2 is an upper plane view for representing a construction of a capping device mounted on a recording apparatus according to a first embodiment of the present invention.
Figure 3A:
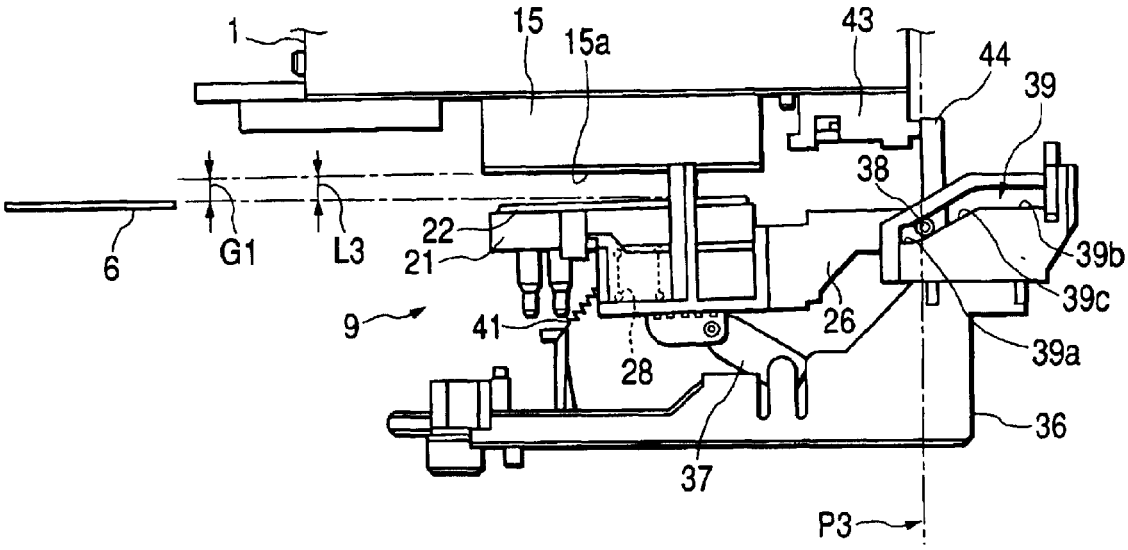
FIGS. 3A and 3B are side views for indicating such a condition that the capping device is located at a flushing position.
Figure 3B:
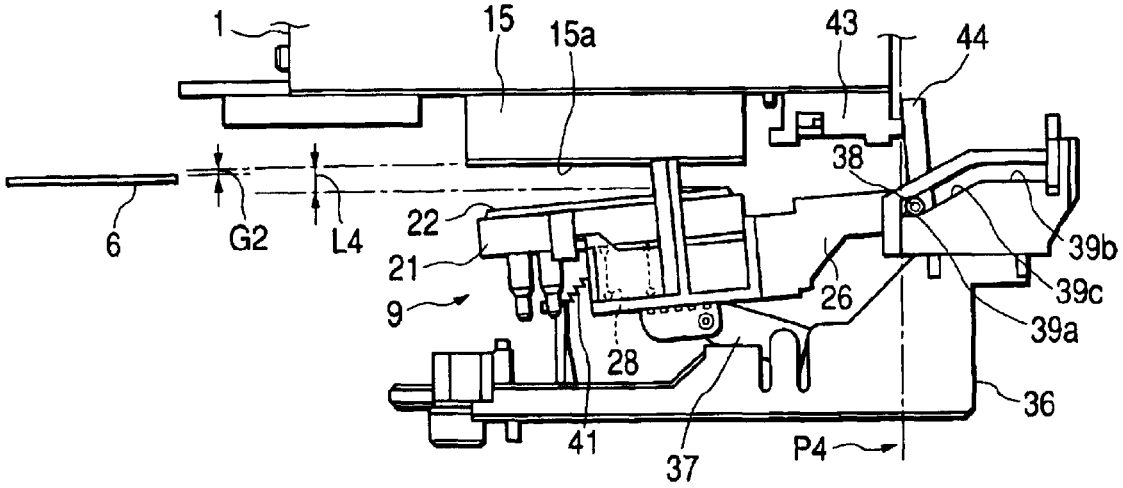
Figure 4A:
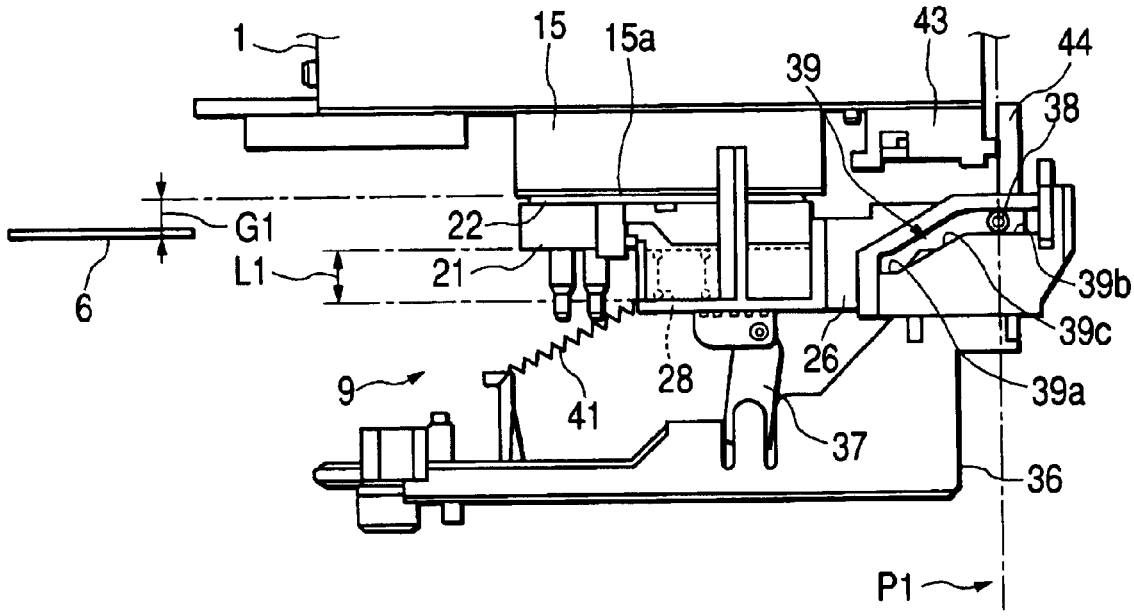
FIGS. 4A and 4B are side views for representing such a condition that a nozzle forming surface of a recording head is capped by the capping device.
Figure 4B:
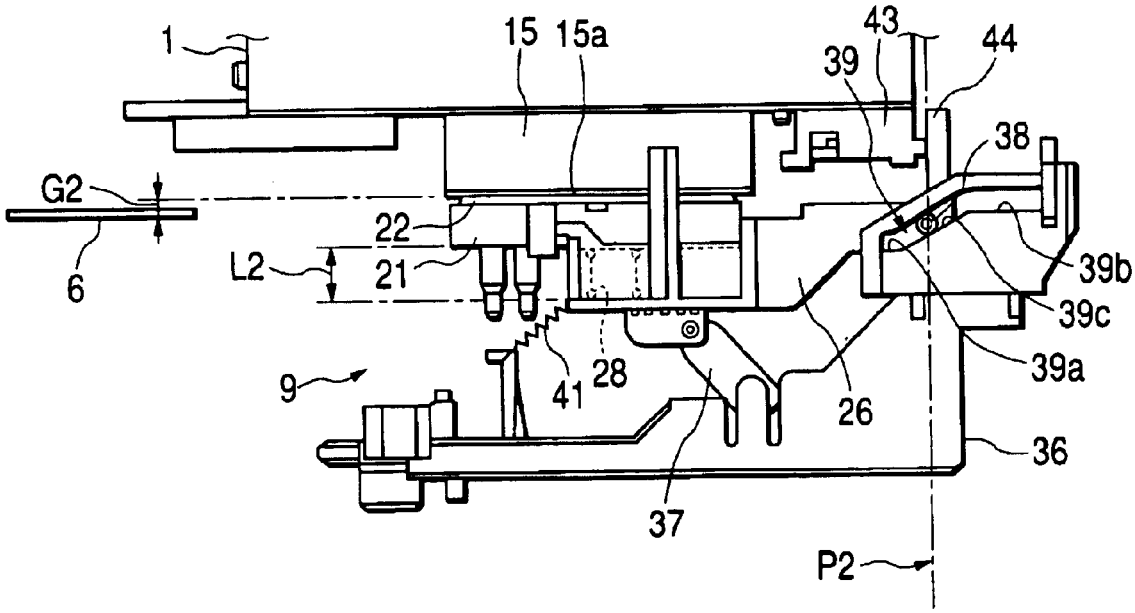

Next, FIG. 2, FIGS. 3A and 3B and FIGS. 4A and 4B mainly represent constructions of the capping device 9 which are mounted on the ink jet recording apparatus according to the first embodiment, to which the present invention has been applied. FIG. 2 represents such a condition that the capping device 9 is viewed from an upper plane, and both FIG. 3A and FIG. 3B show such a condition that the capping device 9 is moved to a flushing position, which is observed from a side surface. Furthermore, FIG. 4A and FIG. 4B represent such a capping condition that the capping device 9 caps the recording head, which is observed from the side surface. In FIG. 2, the construction of the capping device 9 is indicated in an enlarge manner with respect to FIGS. 3A and 3B and FIGS. 4A and 4B.

First, reference numeral 1 shown in FIGS. 3A and 3B is the above-described carriage, and a recording head 15 is mounted on a lower bottom surface of this carriage 1. A cap holder 21 which is formed in a rectangular shape is provided with the capping device 9 capable of capping a nozzle forming surface 15*a* of the above-described recording head 15. A cap member 22 made of a flexible material such as an elastomer is formed in such a manner that this cap member 22 covers both an inner bottom portion and an upper portion of an opening peripheral portion as to this cap holder 21. Then, as shown in FIG. 2, two sets of ink ejection ports 23 are formed in such a manner that these ink ejection ports 23 penetrate through both the cap member 22 and the cap holder 21. These ink ejection ports 23 receive the negative pressure of the above-explained suction pump 10 connected to the own ink ejection ports 23, so that the ink ejection ports 23 can suck the ink from the recording head 15 and can eject the sucked ink.

While a sheet-shaped ink absorption material 24 is stored in the inner bottom portion of the cap member 22 formed on the cap holder 21 in such a manner that this sheet-shaped ink absorption material 24 covers the ink ejection port 23, this sheet-shaped ink absorption material 24 is operable to temporarily hold therein such ink which is ejected from the recording head 15 by performing either the cleaning operation or the flushing operation in conjunction with jetting of ink droplets. Then, the cap holder 21 is mounted on a slider 26 which constitutes an elevator mechanism.

A spring member 28 is arranged between the above-described slider 26 and the cap holder 21, as indicated in FIGS. 3A and 3B and FIGS. 4A and 4B. The cap holder 21 is urged by this spring member 28 in such a manner that this cap holder 21 is upwardly projected with respect to the slider 26. With employment of this construction, under such a condition that the nozzle forming surface of the recording head is capped as represented in FIGS. 4A and 4B, the spring member 28 is slightly compressed, and resilient force of this spring member 28 may cause the cap member 22 formed on the cap holder 21 abuts with respect to the nozzle forming surface with having proper pressure.

As indicated in FIG. 2, a supporting member 30 is formed at a substantially center portion of the slider 26, whereas a pair of supporting members 31 are formed on an edge portion of the slider 26 in such a manner that the paired supporting members 31 are projected along the horizontal direction. On the other hand, supported members 33 and 34 are formed on the cap holder 21, while these supported members 33 and 34 are supported by the three sets of the above-explained supporting members 30 and 31. A tip portion of the supported member 33 which is formed at a center of the edge portion of the cap holder 21 is formed in a T-shape. Also, a pair of the above-described supported members 34 which are formed on both side surfaces of the another edge portion of the cap holder 21 are formed in such groove shapes which own lower bottom portions and are raised along vertical direction.

Then, the T-shaped supported member 33 which is formed on the cap holder 21 is stored into the central supporting member 30 formed on the slider 26, and is supported in such a manner that this T-shaped supported member 33 is movable along the vertical direction. Also, the tip portions of the pair of the supporting members 31 are entered into the pair of the supported members 34 which are formed in the groove shapes in the cap holder 21, while these paired supporting members 31 formed in such a manner that the tip portions thereof are projected with respect to the slider 26 along the horizontal direction, which supports the cap holder 21 in such a manner that the cap holder 21 is movable along the vertical direction. As a result, the cap holder 21 is mounted on the slider 26 under such a condition that this cap holder 21 is restricted to be projected form the slider 26, while a length of this projected cap holder 21 is longer than, or equal to a predetermined length.

On the other hand, as shown in FIGS. 3A and 3B and FIGS. 4A and 4B, a lower bottom portion of the slider 26 is pivotally supported on the side of a free end of a link arm 37, and this link arm 37 is rotatably mounted with respect to a frame 36. With respect to this arrangement, the slider 26 may be raised through the link arm 37, while owing a substantially arc-shaped locus.

Also, a pair of guide projections 38 are formed along the horizontal direction on both sides of the edge portion of the slider 26 on the side of home position. These paired guide projections 38 are constructed in such a manner that these paired guide projections 38 are supported by a pair of guide grooves 39 which are formed in the frame 36. This guide groove 39 is constituted by a lower portion 39*a* formed in one edge portion thereof, a horizontal higher portion 39*b* formed in the other edge portion thereof, and furthermore, an inclined portion 39*c* for connecting these lower portion 39*a* and higher portion 39*b* with each other. These three regions are formed in such a manner that these regions are communicated with each other.

Furthermore, while a tension spring 41 is tensed between the slider 26 and the frame 36, the slider 26 is urged in a printing area direction, and further, in such a direction along which this slider 26 is separated from the recording head 15. In other words, in this embodiment, the slider 26 is urged in such a way that this slider 26 is drawn downwardly.

Then, an abutting member 43 arranged on the side of the carriage 1 is constituted as follows. That is, when the carriage 1 is moved just above the capping device 9, this abutting member 43 abuts against a pair of cylinder-shaped abutted member 44 which are formed in such a manner that these abutted members 44 stand on the slider 26 at an upright position, so that the slider 26 can be moved along the move direction of the carriage. In other words, both the abutting member 43 and the abutted members 44 may constitute a driving force transmitting device for transmitting driving force form the side of the carriage 1 to the side of the slider 26.

When the above-described slider 26 is moved through this driving force transmitting device along the move direction of the carriage 1, as shown in FIGS. 4A and 4B, the slider 26 is stood up through the link arm 37, while this slider 26 exerts force against the tension force of the spring 41. At the same time, a pair of guide projections 38 are traveled along a pair of guide grooves 39 formed in the frame 36 from the inclined portion 39*c* to the higher portion 39*b*. As a result, the cap member 22 formed on the cap holder 21 may cap, or seal the nozzle forming surface 15*a* of the recording head 15 mounted on the carriage 1.

Also, in such a case that the carriage 1 is transported to the printing area side, the abutting effect of the abutting member 43 provided on the side of the carriage 1 with respect to the abutted member 44 arranged on the slider 26 may be released, and the slider 26 is recovered to such a condition shown in FIG. 3B by using the tension force of the spring 41. As a result, the sealing effect by the cap member 22 with respect to the nozzle forming surface 15*a* of the recording head 15 may be released.

As represented in FIGS. 3A and 3B, under such a condition that the capping device is located at the flushing position, a sealing plane in the cap member 22, namely an upper edge plane thereof which abuts against the nozzle forming surface 15*a* of the recording head 15, is brought into a non-parallel condition with respect to this nozzle forming surface 15*a* of the recording head 15. In other words, the seal plane of the cap member 22 is brought into an inclined condition in such a manner that this sealing plane is slightly moved downwardly to the printing area side with respect to the edge portion of the home position side (namely, right side viewed in FIGS. 3A and 3B). This is so arranged by considering such a relationship among the length of the link arm 37 which links the frame 36 to the slider 26, and the positional arrangement of the guide projection 38 which is slid along the guide groove 39 formed in the frame 36.

Under such a condition that the cap member 22 seals the nozzle forming surface 15*a* of the recording head 15, this cap member 22 is operated as follows. Under such a condition, the cap member 22 firstly abuts against the nozzle forming surface 15*a* from the home position side, and then, seals the entire plane of this nozzle forming surface 15*a* of the recording head 15 in accordance with the compression effect of the spring member 28 which is caused by lifting up the slider 26. Also, in the case that the cap member 22 releases sealing of the nozzle forming surface 15*a* of the recording head 15, this cap member 22 is firstly separated from the edge portion of the printing area side with respect to the nozzle forming surface 15*a* of the recording head 15, and then, is separated with respect to the nozzle forming surface 15*a* under non-parallel condition.

As described above, when sealing of the nozzle forming surface 15*a* of the recording head 15 is released, the cap member 22 is separated from the edge portion of the printing area side with respect to the nozzle forming surface 15*a* of the recording head 15, and then, is separated with respect to the nozzle forming surface 15*a* under non-parallel condition. As a result, such a wasted ink which remains in the nozzle forming surface 15*a* of the recording head 15 may receive such an effect that this wasted ink is returned to the side of the wasted ink which is reserved within the cap member 22. Thus, based upon such an effect, the amount of ink which is left in the nozzle forming surface 15*a* of the recording head 15 can be reduced as small as possible. Also, since the seal releasing operation of the cap member 22 with respect to the nozzle forming surface 15*a* of the recording head 15 is progressed from one edge portion, such a phenomenon can also be lowered. That is, in this phenomenon, the wasted ink reserved in the cap member 22 may unnecessarily bubble.

Figure 5:
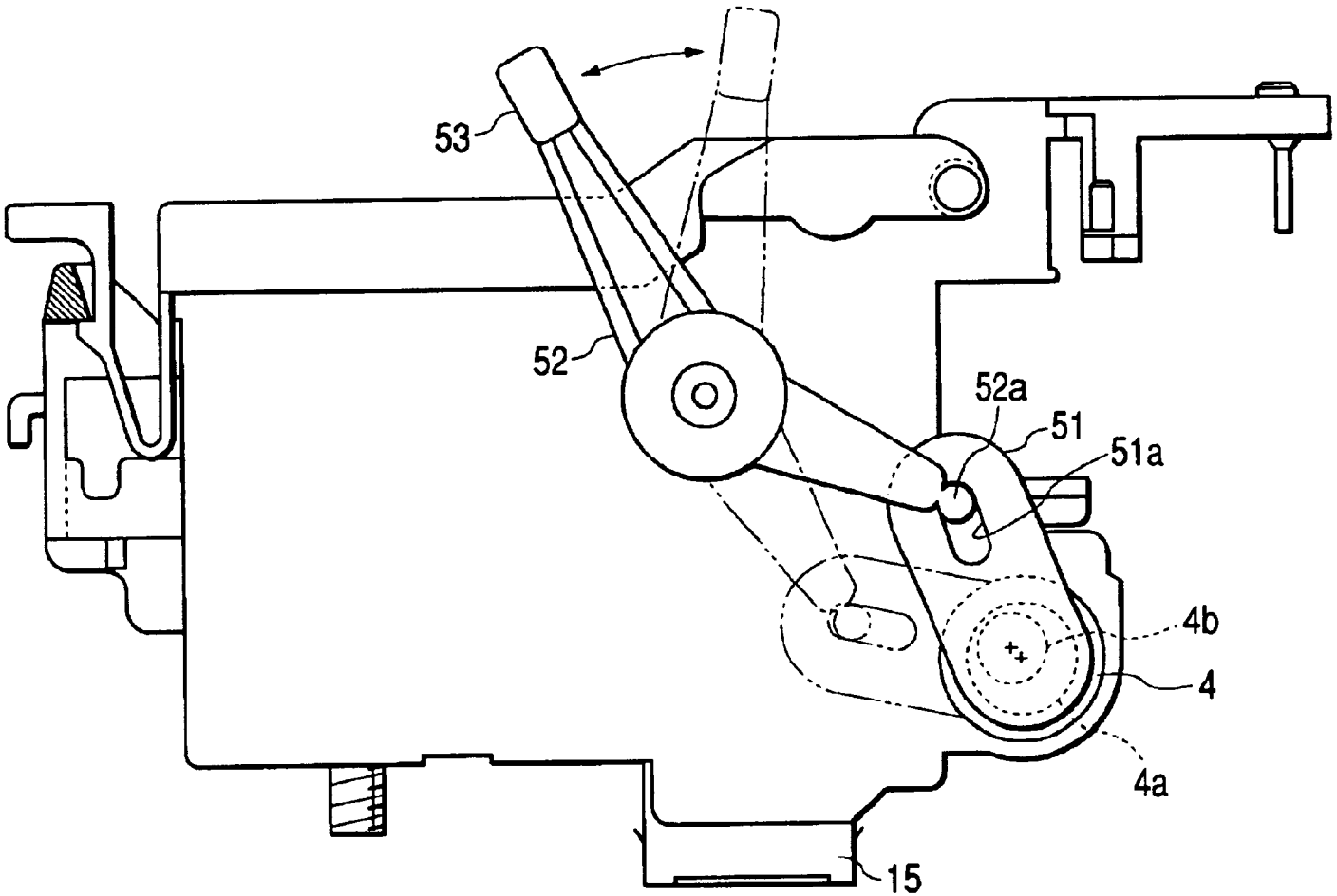
FIG. 5 is a side view for representing an example of a platen gap adjuster mounted on the recording apparatus.

On the other hand, in FIG. 5, there is shown one example of a platen gap adjuster which is mounted on the above-described recording apparatus. The carriage 1 as represented in FIG. 5 is constructed in such a manner that this guide member 4 is guided so as to be transported along a direction perpendicular to the drawing plane of FIG. 5. Then, a center shaft 4*a* is stored into this guide member 4 in such a manner that this center shaft 4*a* is rotatable within this guide member 4. Furthermore, this center shaft 4*a* is supported by an eccentric shaft 4*b* at right/left ends of this center shaft 4*a* along a longitudinal direction thereof. The eccentric shaft 4*b* is supported by right/left frames in the recording apparatus. An actuation lever 51 provided with a slide groove 51*a* is coupled to the center shaft 4*a*. Within the slide groove 51*a* formed in this actuation lever 51, a slider 52*a* is slidably inserted. This slider 52*a* is arranged on an operated edge in the operation lever 52, the central portion of which is supported on the above-described lever.

An operation member 53 is mounted on the edge portion of the operation lever 52 on the operation side thereof, while this operation member 53 can pivot this operation lever 52. As a result, since the operation lever 52 is pivoted along an arrow direction by utilizing the operation member 53, the carriage 1 which mounts the recording head 15 can be moved along the vertical direction. In other words, in this embodiment, since the operation lever 62 is pulled forwardly (namely, operation lever is rotated along left direction as viewed in FIG. 5) as indicated by a solid line, the actuation lever 51 is rotated along a right direction in this drawing. As a consequence, the carriage 1 is slightly moved because of the effect of the eccentric shaft 4*b*, so that the recording head 15 is transported downwardly, which may cause the interval between the platen 5 and the gap to be narrowed as shown in FIG. 1.

Also, since the operation lever 52 is stood under upright condition as indicated in a chain line, the actuation lever 51 is rotated along the left direction as viewed in this drawing. As a result, the carriage 1 is lifted up due to the effect of the above-explained eccentric shaft 4*b*. As a result, the recording head 15 is moved upwardly, which may cause the interval between the platen 5 and the gap to be widened, as shown in FIG. 1.

As may be understood from the above-explained effect, in the case that the platen gap adjuster is manipulated, the interval between the capping device and the nozzle forming surface of the recording head is apparently varied. This capping device is located on the flushing position. Similarly, in such a case that the nozzle forming surface of the recording head is capped by the capping device, the pressing force exerted by this capping device to the nozzle forming surface is also varied.

Under such a circumstance, FIGS. 3A and 3B indicate such a control mode that the position of the capping device which is located at the flushing position can be controlled in the case that the platen gap adjuster is operated. FIG. 3A shows a control mode in the case that the platen gap is large, whereas FIG. 3B indicates a control mode in the case that the platen gap is small.

First, in such a case that the platen gap is large, as represented in FIG. 3A, a distance between a sheet surface of the recording paper 6 and the nozzle forming surface 15*a* of the recording head 15, namely a gap interval is denoted by "G1". Also, in the case that the platen gap is small, as shown in FIG. 3B, another distance between a sheet surface of the recording paper 6 and the nozzle forming surface 15*a* of the recording head 15, namely another gap interval is denoted by T"G2". In other words, when the platen gap is adjusted, the recording head 15 may be moved over a distance denoted by a distance "ΔG" (see FIG. 10).

In such a case that the platen gap is large as represented in FIG. 3A, a regulating operation is carried out in such a manner that a position of the abutting member 43 mounted on the carriage 1 is stopped at a position "P3" shown in this drawing. That is to say, in the case that the carriage 1 is stopped at the above-described position "P3", as indicated in FIG. 3A, the guide projection 38 formed on the slider 26 which is transported by the abutting member 43 is moved to a relatively low position at the inclined portion 39*c* of the guide groove 39 formed in the frame 36. In response to this movement, the above-described link arm 37 is also slightly raised. In this case, a distance between the nozzle forming surface 15*a* of the recording head 15 and the cap member 22 employed in the capping device 9 is indicated as "L3", for the sake of convenience.

On the other hand, in such a case that the platen gap is small as represented in FIG. 3B, a regulating operation is carried out in such a manner that a position of the abutting member 43 mounted on the carriage 1 is stopped at a position "P4" shown in this drawing. That is to say, in the case that the carriage 1 is stopped at the above-described position "P4", as indicated in FIG. 3B, the guide projection 38 formed on the slider 26 which is transported by the abutting member 43 is moved to the lower portion 39*a* of the guide groove 39 formed in the frame 36. In other words, this guide projection 38 is essentially positioned at the lowermost portion of the inclined portion 39*c*. In response to this movement, a degree of raising of the above-explained link arm 37 is small, as compared with the raising degree of the above-described case shown in FIG. 3A. In this case, distance between the nozzle forming surface 15*a* of the recording head 15 and the cap member 22 employed in the capping device 9 is indicated as "L4", for the sake of convenience.

As a consequence, the above-described distances "L3" and "L4" can be controlled in correspondence with the transport position of the carriage 1, and also, such a setting condition that L3=L4 can be established by controlling the travel position of the abutting member 43 in response to the information of the platen gap. Accordingly, it is possible to set that the distances between the nozzle forming surface 15*a* of the recording head and the capping device 9 are made substantially equal to each other irrespective of the dimensions of the platen gaps. Therefore, it is possible to suppress the occurrence of the above-described problem in the case that the distance between the nozzle forming surface 15*a* of the recording head 15 and the capping device 9 is short, and also the occurrence of the above-described problem in the case that the above-explained distance is long. As will be explained later, setting of the distances between both the nozzle forming surface 15*a* and the capping device 9 may be realized by controlling rotations of a carriage motor which drives the carriage 1.

Next, FIGS. 4A and 4B indicate such a control mode that when the platen gap adjuster is manipulated, an abutting degree of the capping device 9 with respect to the nozzle forming surface 15*a*, which is located at the capping position, can be controlled. FIG. 4A shows a control mode executed when the platen gap is large, whereas FIG. 4B represents a control mode executed when the platen gap is small.

In such a case that the platen gap is large as represented in FIG. 4A, a regulating operation is carried out in such a manner that a position of the abutting member 43 mounted on the carriage 1 is stopped at a position "P1" shown in this drawing. That is to say, in the case that the carriage 1 is stopped at the above-described position "P1", as indicated in FIG. 4A, the guide projection 38 formed on the slider 26 which is transported by the abutting member 43 is positioned at the higher portion 39*b* of the guide groove 39 formed in the frame 36. In other words, this guide projection 38 is positioned at the highest portion of the inclined portion 39*c*. In response to this movement, the link arm 37 is raised up to the top position.

With employment of such an operation, the nozzle forming surface 15*a* is sealed by the cap member 22. At the same time, the spring member 28 is compressed which is interposed between the slider 26 and the cap member 21. Since this spring member 28 exerts urging force, the cap member 22 may abut against this nozzle forming surface 15*a* of the recording head 15. In this case, the compressed length of the spring member 28 is indicated as "L1", for the sake of convenience.

On the other hand, in such a case that the platen gap is large as represented in FIG. 4B, a regulating operation is carried out in such a manner that a position of the abutting member 43 mounted on the carriage 1 is stopped at a position "P2" shown in this drawing. That is to say, in the case that the carriage 1 is stopped at the above-described position "P2", as indicated in FIG. 4B, the guide projection 38 formed on the slider 26 which is transported by the abutting member 43 is positioned at a substantially intermediate portion of the inclined portion 39*c* of the guide groove 39 formed in the frame 36. In response to this movement, a raising degree of the above-described link arm 37 is also small, as compared with the raising degree of the case shown in FIG. 4A.

As a consequence, the nozzle forming surface 15*a* is sealed by the cap member 22. At the same time, the spring member 28 is compressed which is interposed between the slider 26 and the cap member 21. Since this spring member 28 exerts urging force, the cap member 22 may abut against this nozzle forming surface 15*a* of the recording head 15. In this case, the compressed length of the spring member 28 is indicated as "L2", for the sake of convenience.

As described above, the positions of the slider 26 along the vertical direction can be regulated in response to the transport position of the carriage 1. As a result, such a setting operation may be carried out. That is, the compressed lengths of the above-described spring member 28 may be substantially equal to each other (L1=L2) irrespective of the dimension of the platen gap, while this spring member 28 urges the cap member 22 toward the nozzle forming surface 15*a*. Accordingly, the abutting pressure of this cap member 22 against the nozzle forming surface 15*a* of the recording head 15 can be made substantially equal to each other, irrespective of the dimension of the platen gap. The setting operation of the transport positions of the carriage 1 may be realized by controlling the rotation of the carriage motor which drives the carriage 1 (will be discussed later).

Figure 6:
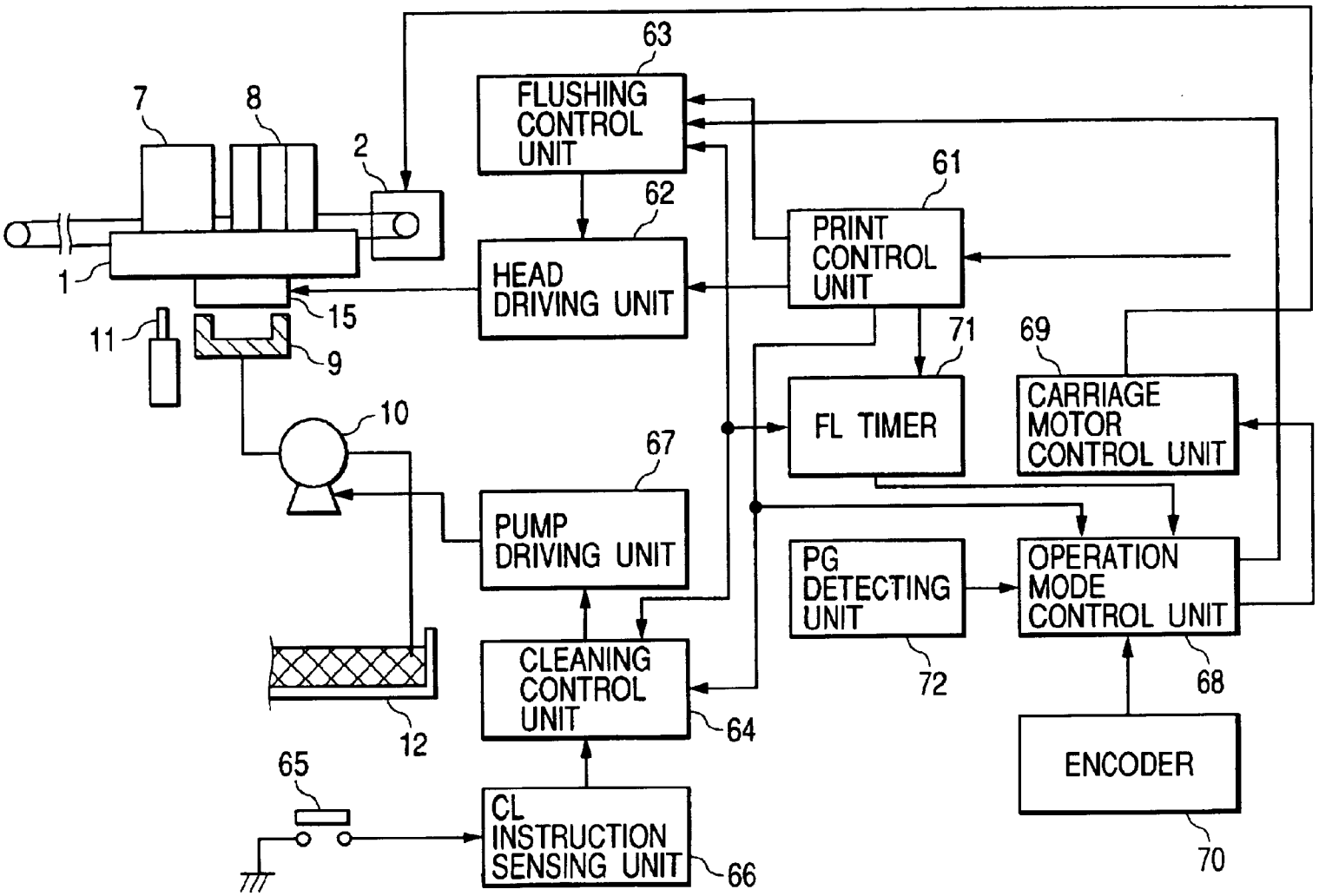
FIG. 6 is a block diagram for showing one example of a control circuit mounted on the recording apparatus.

FIG. 6 schematically shows an arrangement of a control means used to realize the above-described various operations. As to the previously described carriage 1, carriage motor 2, ink cartridges 7 and 8, capping device 9, suction pump 10, and wiping member 11, the same reference numerals are employed so as to indicate these components in FIG. 6. Then, as indicated in FIG. 6, while the suction pump 10 is connected to the capping device 9, the ejection side of this suction pump 10 is connected to a wasted ink tank 12.

Reference numeral 61 shown in FIG. 6 indicates a print control unit. This print control unit 61 produces bit map data based upon print data supplied from a host computer (not shown), and is provided with the following function. That is, in accordance with this bit map data, a drive signal is generated from a head drive means 62 so as to jet ink droplets from the recording head 15 mounted on the carriage 1. This head drive means 62 is also arranged in such a way that another drive signal for a flushing operation is outputted to the recording head 15 by receiving the drive signal generated based upon the print data and also by receiving a flushing instruction signal supplied from a flushing control unit 63.

Reference numeral 64 indicates a cleaning control unit. This cleaning control unit 64 is provided with a function capable of executing a cleaning operation in response to an instruction signal supplied from a cleaning instruction 15 sensing unit 66 which receives, for example, an ON-instruction of a cleaning instruction switch 65 arranged on an operation panel. Also, this cleaning control unit 64 is equipped with a function capable of similarly executing the cleaning operation also in the case that this cleaning control unit 64 receives a cleaning instruction through the print control unit 61 from the above-explained host computer.

The cleaning control unit 64 is equipped with another function. That is, when the cleaning instruction is received, this cleaning control unit 64 controls a pump drive means 67 so as to drive the suction pump 10. Then, since the suction pump 10 is driven, negative pressure is applied to an internal space of the capping device 9, so that the ink is sucked/ejected from the nozzle openings of the recording head 15. Also, under such a condition that sealing of the nozzle forming surface 15*a* by the capping device 9 is released, the cleaning control unit 64 again drives the suction pump 10, so that the wasted ink which is ejected into the internal space of the capping device 9 can be disposed into the wasted ink tank 12.

A control signal is sent out from the print control unit 61 with respect to the operation mode control unit 68. This operation mode control unit 68 sends out a control signal to the carriage motor control unit 69 in order that the driving operation of the carriage motor 2 can be controlled. Then, it is so arranged that a signal derived from an encoder 70 is supplied to the operation mode control unit 68.

This encoder 70 owns such a function capable of, for example, optically sensing the moving position of the carriage 1. To this end, although not shown in this drawing, while a large number of optical slits are arranged along the move direction of the carriage 1, the moving position of the carriage 1 can be detected by counting as to whether or not there is such light which may pass through the respective slots in accordance with the scanning operation of the carriage 1.

Also, a control signal derived from a flushing timer 71 is sent out with respect to the operation mode control unit 68. This flushing timer 71 is operated as follows. For instance, while a printing operation is carried out, when such a printing operation is continued for a predetermined time duration (namely, 10 seconds in this embodiment), the flushing timer 71 sends out the control signal to the operation mode control unit 68. In response to this operation, the operation mode control unit 68 supplies a control signal to the carriage motor control unit 69 so as to perform such an operation that the carriage 1 is transported to the flushing position. Also, while the flushing timer 71 sends out a control signal to the flushing control unit 63, in response to this control signal, a flushing control signal is sent out from the flushing control unit 63 to the head drive means 62.

On the other hand, information of the platen gap is supplied from a platen gap detecting unit 72 to the operation mode control unit 68. In this embodiment, such information for indicating as to whether the platen gap is large, or small is supplied to the operation mode control unit 68. As a consequence, depending upon the manipulation position of the operation lever 52 shown in FIG. 5, for example, a microswitch (not shown in this drawing) is ON/OFF-controlled, and thus, an electric signal which is produced based upon the information derived from this microswitch is supplied to the operation mode control unit 68.

Then, while the above-described operation mode control unit 68 utilizes both the information about this platen gap and the positional information of the encoder 70, this operation mode control unit 68 sends out such a control instruction to the carriage motor control unit 69. Based upon this control instruction, the carriage motor control unit 69 stops the carriage 1 at a properly selected position corresponding to a platen gap in each of the flushing position and the capping position.

Figure 7:
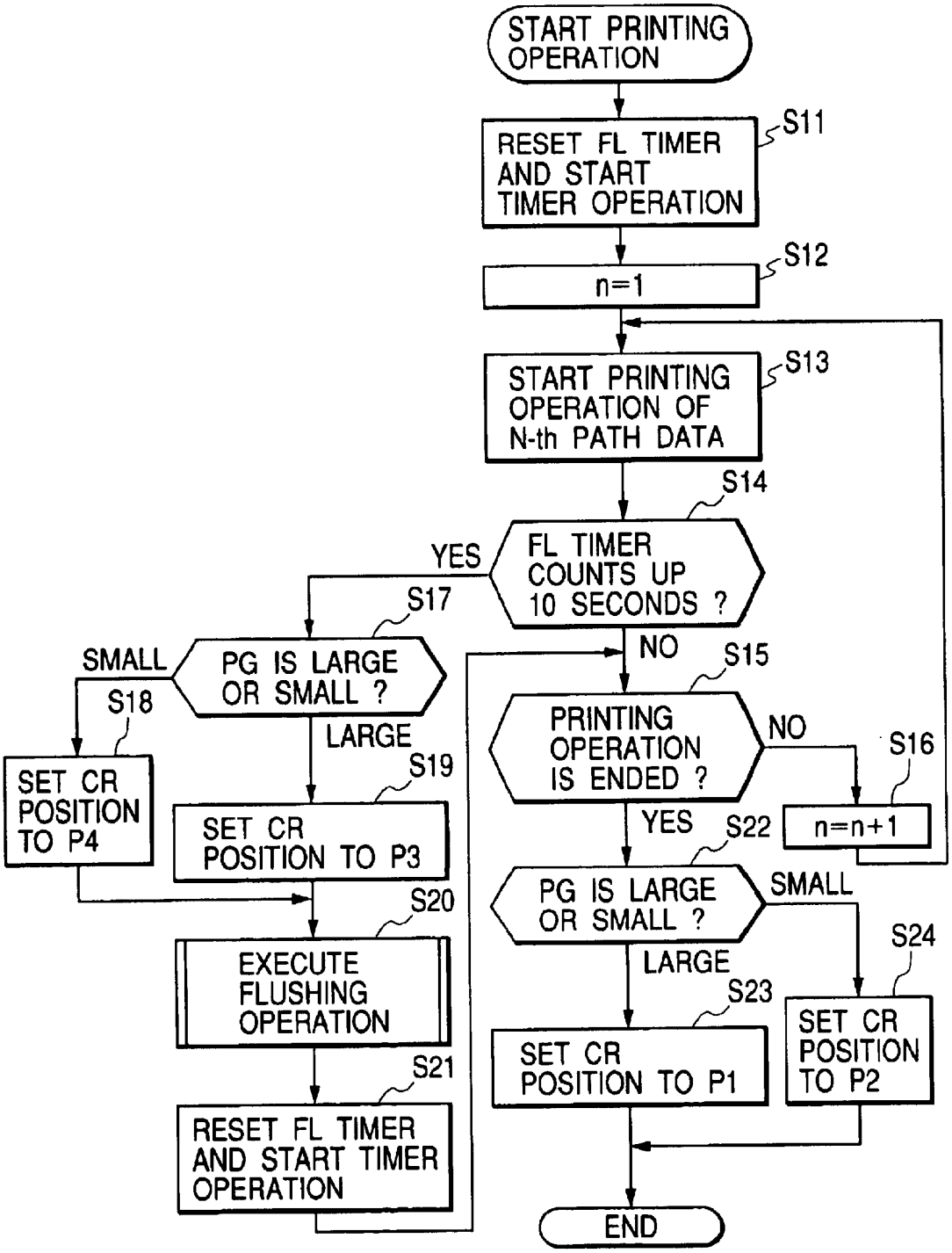
FIG. 7 is a flow chart for describing a control routine executed by the control circuit shown in FIG. 6.

FIG. 7 is a flow chart for explaining a sequential control operation as to the carriage transporting operation executed by the above-described control means. This control sequence shown in FIG. 7 indicates the following sequence. That is, after a printing operation is commenced, a flushing operation is carried out at predetermined timing, and then, the nozzle forming surface of the recording head is capped by the capping device after the printing operation has been completed.

In FIG. 7, first of all, when the printing operation is commenced, the flushing timer 71 is reset and immediately starts a time counting operation in a step S11. This operation may be realized by that the control signal is sent to the flushing timer 71 by the printing control unit 61 in FIG. 6. Subsequently, based upon bit map data which is expanded in the print control unit 61, an "n"-th path of print data is set as indicated in a step S12, while symbol "n" indicates 1 (namely, n=1). Then, this control sequence of the carriage transporting operation is advanced to a step S12 in which a printing operation as to this n-th path of print data is commenced.

The carriage 1 is scanned in such a manner that a control signal is supplied from the print control unit 61 shown in FIG. 6 to the operation mode control unit 68, and then, a command signal is supplied by the operation mode control unit 68 to the carriage motor control unit 69 based upon this control signal. Then, while an "n"-th (n=1) path of bit map data is sent out from the print control unit 61 to the head drive means 62, the printing operation is carried out based upon this bit map data.

Subsequently, in a step S14, the control means refers to the time count data of the flushing timer 71 in order to judge as to whether or not 10 seconds have passed. When it is so judged in this step S14 that 10 seconds have not yet elapsed ("NO"), the control means judges as to whether or not the printing operation is ended in a step S15. When it is so judged in this step S15 that the printing operation is not ended ("NO"), the print path is incremented (n+1) in a step S16. Then, the control operation is again returned to the previous step S13. Such a printing operation defined from this step S13 up to the step S16 is repeatedly carried out.

Then, in the case that the control means judges in the above-described step S14 that the flushing timer 71 counts 10 seconds ("YES"), the control operation is advanced to a further step S17. In this step S17, the execution condition of the flushing operation is prepared. In this step S17, the control means refers to the information about a platen gap. In the case that the platen gap is small, the control operation is advanced to a further step S18. In this step S18, the control means controls the carriage 1 in such a manner that the position of this carriage 1 is moved to the position "P4." In other words, the carriage 1 is brought into the above-explained condition shown in FIG. 3B. Also, in the case that it is so judged that the platen cap is large, the control operation is advanced to a step S19. In this step S19, the control means controls the carriage 1 in such a manner that the position of this carriage 1 is moved to the position "P3."

In other words, the carriage 1 is brought into the above-explained condition shown in FIG. 3A.

The above-described operation is carried out in such a way that the operation mode control unit 68 shown in FIG. 6 receives each of the above-described information derived from the flushing timer 71, the platen gap detecting unit 72, and the encoder 70, and then, sends out the control signal to the carriage motor control unit 69. Then, in a step S20, the flushing operation is carried out. In this case, as previously explained, while the distance between the capping device 9 which is moved to the flushing position and the nozzle forming surface 15*a* of the recording head 15 is adjusted in correspondence with the platen gap, the flushing operation can be executed by maintaining a proper interval between both the capping device 9 and the nozzle forming surface 15*a*.

When the above-described flushing operation is accomplished, the flushing timer 71 is reset as indicated in a step S21, and then, the time counting operation is immediately started by this flushing timer 71. Thereafter, the control operation is advanced to the above-described step S15. In this step S15, the control means judges as to whether or not the printing operation is ended. Until the printing operation is accomplished, both the above-explained printing operation and the regularly-executed flushing operation are repeatedly carried out.

When it is so judged in the above step S15 that the printing operation is ended ("YES"), the control operation is advanced to a step S22 in which the execution condition of the capping operation is prepared. Also, in this step S22, while the control means refers to information about the platen gap, in such a case that the platen gap is large, the control operation is advanced to a further step S23. In this step S23, the control means controls the carriage 1 in order that the position of this carriage 1 is moved to the point "P1." In other words, such a condition of FIG. 4A is assumed as a waiting condition. To the contrary, in the case that it is so judged in this step S22 that the platen gap is small, the control operation is advanced to a step S24. In this step S24, the control means controls the carriage 1 in order that the position of this carriage 1 is moved to the point "P2." In other words, such a condition of FIG. 4B is assumed as a waiting condition.

As previously described, while this control operation is carried out, the capping operation may be carried out under such a condition that the compressed lengths of the spring member 28 become substantially same with each other (L1=L2) irrespective of the dimensions of the platen gaps, while this spring member 28 urges the cap member 22 toward the nozzle forming surface 15*a* of the recording head 15.

In this embodiment, the microswitch is utilized so as to acquire the information with respect to the dimensions of the platen gaps, while this microswitch is ON/OFF-controlled in accordance with the manipulation position of the operation lever 52 shown in FIG. 5. The above-described sufficiently practical functions may be obtained even when such binary information of the microswitch is utilized. Alternatively, for instance, information derived from a rotary encoder may be utilized, while a linear electric signal is obtained in response to a pivot angle of the operation lever 52 shown in FIG. 5. In this alternative case, upper/lower positions of the capping device 9 may be controlled in a finer mode in response to an adjusting degree of the platen gap.

In the above-described recording apparatus of the first embodiment, while the interval between the cap member and the nozzle forming surface is adjusted in accordance with the adjustment of the platen gap, the produced amount of ink mist can be reduced when, for example, the flushing operation is carried out. Similarly, in the below-mentioned recording apparatus according to a second embodiment of the present invention, a produced amount of ink mist maybe decreased. This recording apparatus of the second embodiment is featured by performing such a control operation so as to reduce an occurrence of such ink mist when an adjustment of a platen gap is carried out, while an interval between a cap member and a nozzle forming surface of a recording head is not forcibly adjusted.

Next, a description is made of the recording apparatus according to the second embodiment. A basic arrangement of this recording apparatus according to the second embodiment is made similar to that of the recording apparatus of the first embodiment as shown in FIG. 1. Then, the recording apparatus of the second embodiment is also arranged by that a capping device 9 may realize a function of an ink receptor (namely, flushing area) capable of receiving ink droplets which are flushed from a recording head while a flushing operation is carried out.

Figure 8:
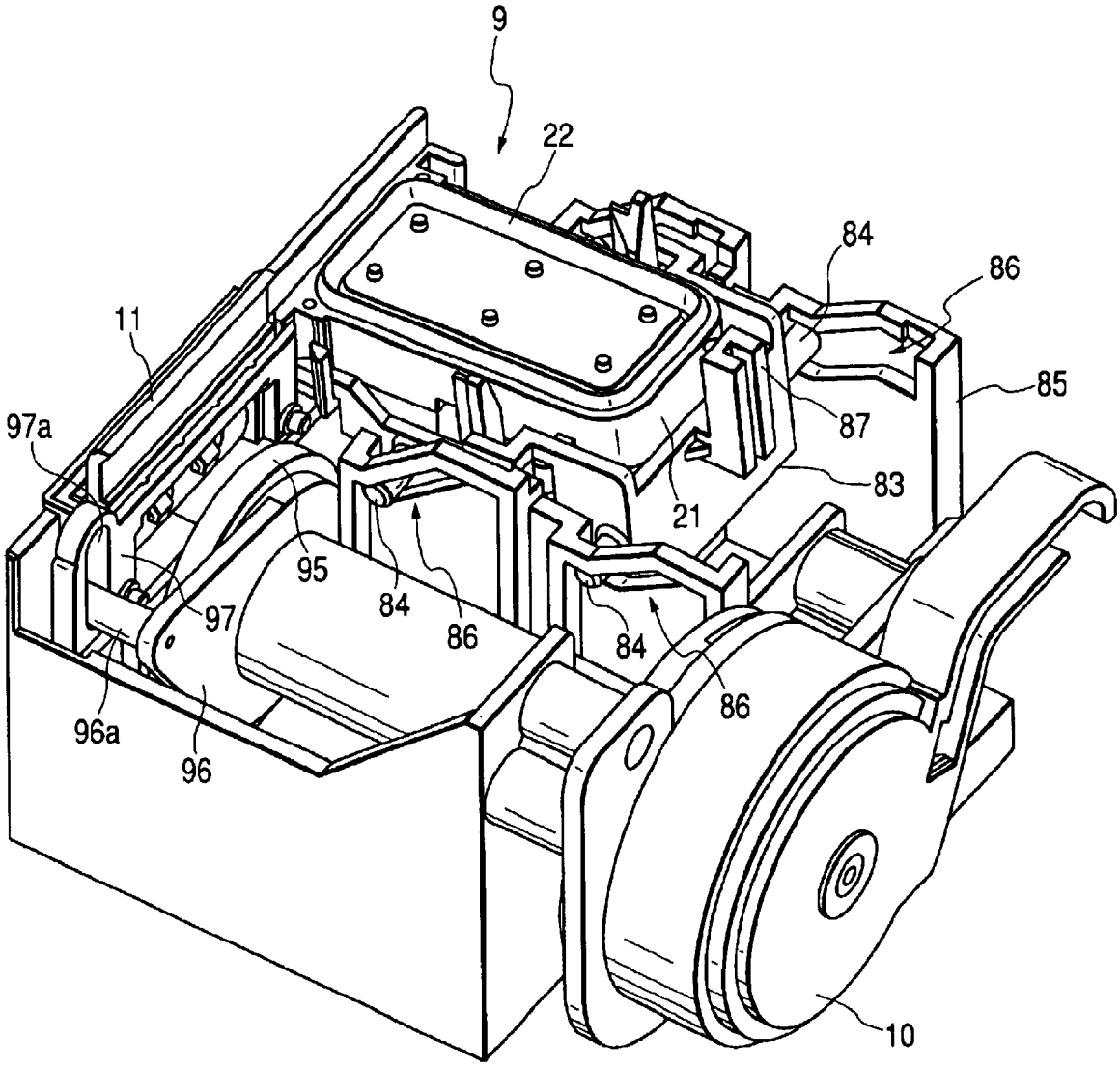
FIG. 8 is a perspective view for indicating an unit such as a capping device drive mechanism and the like, which are mounted on a recording apparatus according to a second embodiment of the present invention.
Figure 9:
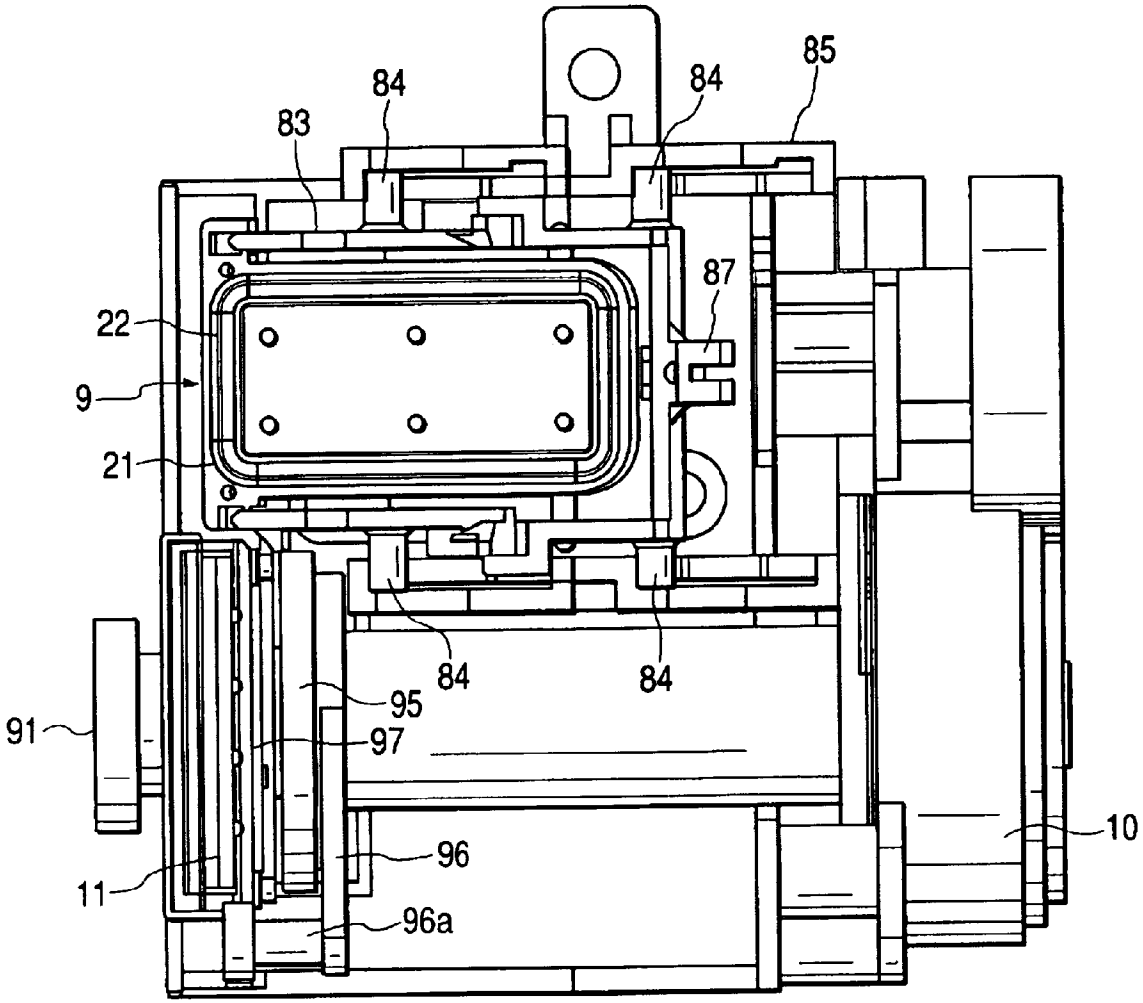
FIG. 9 is a plan view for indicating the unit such as the capping device drive mechanism and the like, which are mounted on the recording apparatus according to the second embodiment of the present invention.

FIG. 8 and FIG. 9 illustratively show such a condition that a drive mechanism of the capping device 9, and another drive mechanism of both a wiping member 11 and a tube pump 10 functioning as a suction pump are arranged in the form of a unit, which are mounted on the recording apparatus of the second embodiment. FIG. 8 indicates these drive mechanisms in the unit form as a perspective view, and FIG. 9 shows these unit mechanisms as a plan view. The major portions corresponding to the above-described recording apparatus of the first embodiment will be explained by employing the same reference numerals.

A cap holder 21 having a rectangular shape is provided with the capping device 9 capable of sealing the nozzle forming surface 15*a* of the recording head 15, while a cap member 22 made of such a flexible material as an elastomer is formed on an opening peripheral edge of this cap holder 21. Then, this cap member 22 is constituted in such a manner that the nozzle forming surface of the recording head can be sealed, or capped.

While the above-described cap holder 21 is mounted on a slider 83 which constitutes an elevator mechanism, a plurality of guide members 84 are formed on this slider 83 along the horizontal direction. Then, the respective guide members 84 are stored into an inclined hole 86 having an elongated-hole shape. This inclined hole 86 is formed in a frame member 85 which slides the above-described slider 83 and holds this slider 83. On the other hand, an engaging projection 87 is formed in an integral form on the slider 83 under upright condition. The engaging projection 87 owns such a function that when the above-described carriage 1 is moved to the home position, since this engaging projection 87 is depressed by an edge portion of the carriage 1, the slider 83 may be moved along the travel direction of the carriage 1.

As a result, in connection with the travel operation of the carriage 1 to the home position side, the respective guide members 84 formed on the slider 83 are operated in such a manner that these guide members 84 slide up the inclined hole 86 having the elongated-hole shape, which is formed in the frame member 85. As a consequence, the nozzle forming surface of the recording head mounted on the carriage 1 may be capped by the capping member 22 formed on the cap holder 21. Also, in the case that the carriage 1 is moved to the print area side, the slider 83 receives a spring effect of a return spring (not shown) to be moved to the print area side. In connection with this movement of the slider 83, the capping operation by the cap member 22 with respect to the nozzle forming surface of the recording head may be released.

Figure 10:
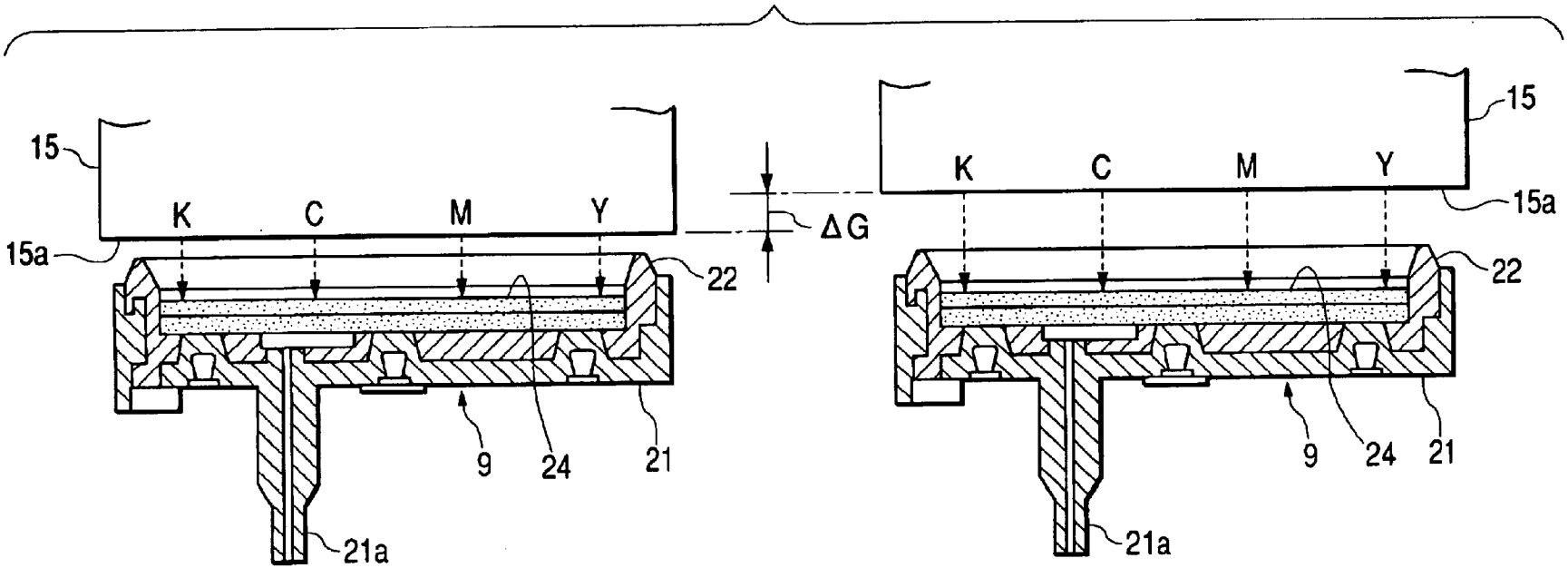
FIG. 10 is a sectional view for indicating a capping device operated under flushing condition.

Furthermore, in such a case that the flushing operation is carried out, in connection with the travel operation of the carriage 1 to the home position side, the respective guide members 84 formed on the slider 83 are driven in such a manner that these guide members 84 may slide up the inclined hole 86 having the elongated-hole shape in a half way thereof. This inclined hole 86 is formed in the frame member 85. As a result, as will be discussed later, the cap member 22 is controlled in such a manner that this cap member 22 is located opposite to the nozzle forming surface of the recording head in a predetermined interval, and the cap member 22 is operated so as to receive ink droplets which are flushed from the recording head under this condition, as shown in FIG. 10.

Although not represented in FIG. 8 and FIG. 9, an ink ejection port (will be discussed later) is formed in an inner bottom portion of the cap holder 21 from this inner bottom portion toward a lower side surface. A tube is connected to this ink ejection port, and this tube constitutes a suction side of a tube pump 10 functioning as the above-described suction pump. This tube pump 10 is used to produce negative pressure in such a way that a flexible tube arranged in an arc shape is sequentially squeezed by a roller. In this tube pump 10, a pumping effect may be produced by rotary-driving a drive wheel 91 shown in FIG. 9 along one direction, whereas the tube pump 10 is brought into a release state by rotary-driving the drive wheel 91 another the other direction. In this second embodiment, the above-explained drive wheel 91 is constituted as follows. The drive wheel 91 is driven through a speed reduction gear train by driving force of a paper feeding motor which may load the recording paper 6 and also may eject the recorded paper.

As a consequence, since the above-described tube pump 10 is driven under such a condition that the cap member 22 which constitutes the capping device 9 caps the nozzle forming surface of the recording head, this tube pump 10 can apply the negative pressure to the nozzle forming surface of the recording head. The ink may be absorbed to be ejected from the recording head by way of the effect of this negative pressure. Then, since the carriage 1 is slightly moved to the print area side, the capping effect by the cap member 22 with respect to the nozzle forming surface may be released. Under this condition, since the tube pump 10 is again driven, the wasted ink which is ejected into the capping device 9 may be sent out through the tube pump 10 to a wasted ink tank.

On the other hand, the recording apparatus is arranged by that a cam-shaped member 96 is pivoted through a clutch plate 95 which is driven in connection with the rotation of the above-described drive wheel 91. While this cam-shaped member 96 is pressured by a spring member (not shown) with respect to the clutch plate 95, the cam-shaped member 96 is so constituted by receiving rotary drive within a predetermined rotation angle by being conducted along the rotation direction of the clutch plate 95. Then, a cylindrical shaped drive pin 96*a* is mounted on the cam-shaped member 96 in such a manner that this drive pin 96*a* is projected along the horizontal direction.

The wiping member 11 is supported on an upper portion of a wiper holder 97 under upright condition, while this wiper holder 97 is constituted in such a manner that this wiper holder 97 can be moved along the horizontal direction. Then, while a groove hole 97*a* is formed in the wiper holder 97, the above-described cylindrical shaped drive pin 96*a* is inserted into this groove hole 97*a*. As a consequence, the cylindrical shaped drive pin 96*a* which is driven through a friction clutch constituted by the clutch plate 95 and the cam-shaped member 96 in a manner of an arc-shaped locus may be slid within the groove hole 97 which is formed in the wiper holder 97 along the vertical direction, so that the drive pin 96*a* may cause the wiper holder 97 to be transported along the horizontal direction. The conditions indicated in FIG. 8 and FIG. 9 represent such reset condition that the wiping member 11 arranged on the upper portion of the wiper holder 97 is evacuated from the move area of the recording head.

In this second embodiment, the recording apparatus is arranged as follows. That is, since the paper feed motor is rotated along one direction, the tube pump 10 may produce the pumping effect. In an initial stage of this motor rotating operation, the wiper holder 97 is driven through the friction gear along the horizontal direction, and the wiping member 11 is brought into such a set condition that this wiping member 11 is advanced to the transport path of the recording head. As a result, since the recording head is transported along the main scanning direction at this time, this nozzle forming surface thereof may be wiped by the wiping member 11. Also, since the paper feeding motor is rotated along the other rotation direction, the tube pump 10 is brought into the release state. In the initial stage of the rotation operation at this time, the wiper holder 97 is driven through the friction clutch along the horizontal direction, and then, the wiping member 11 is brought into such a reset state that this wiping member 11 is evacuated from the transport path of the recording head.

On the other hand, the platen gap adjuster indicated in FIG. 5 is similarly mounted on this recording apparatus of the second embodiment. Then, FIG. 10 shows the following condition as a sectional view. That is, as described above, while the cap member 22 which constitutes the capping device 9 is located opposite to the nozzle forming surface 15*a* of the recording head 15 with maintaining a predetermined interval, the flushing operation is carried out. Incidentally, the left hand side of FIG. 10 indicates such a condition that the platen gap is adjusted to become small by the above-explained platen gap adjuster, whereas the right hand side of FIG. 10 represents such a condition that the platen gap is adjusted to become large by this platen gap adjuster. That is to say, symbol "ΔG" of FIG. 10 represents a range over which the platen gap is adjustable by the platen gap adjuster shown in FIG. 5.

As indicated in FIG. 10, nozzle columns are formed on the nozzle forming surface 15*a* of the recording head 15, while each of the color ink (K, C, M, Y) of black, cyan, magenta, and yellow is jetted from each of these nozzle columns. An ink absorbing material 24 in which a porous material is formed in a sheet shape is stored in an inner bottom portion of the cap member 22 which is located opposite to this nozzle column under flushing condition. Then, under the flushing operation, ink droplets flushed from each of the nozzle columns are received by the ink absorbing material 24. An ink ejection port 21*a* is integrally formed to a cap holder 21 in such a manner that this ink ejection port 21 is projected from the inner bottom portion of the cap holder 21 to the lower side surface. The tube is connected to this ink ejection port 21*a*, while this tube constitutes the absorption side of the tube pump 10 as the above-described absorption pump.

Figure 11A:
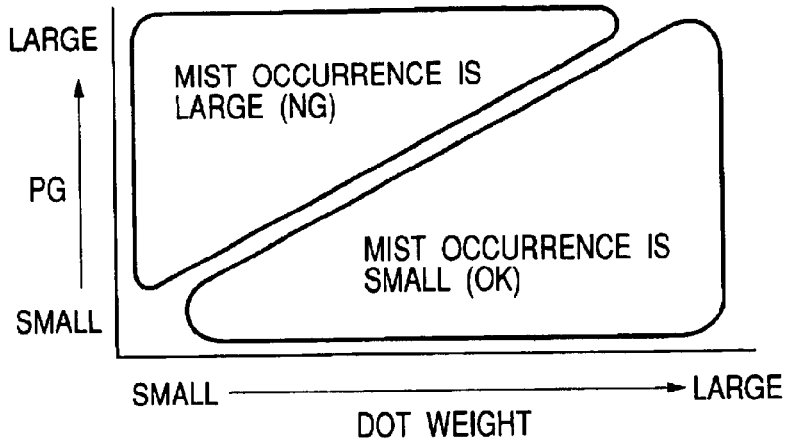
FIGS. 11A, 11B and 11C are characteristic diagrams for indicating a correlative relationship between a platen gap and a flushing dot weight.

As indicated in FIG. 10, a distance between the capping device 9 and the nozzle forming surface 15*a* of the recording head 15 is changed within the above-explained range of "ΔG" by adjusting a platen gap. In this case, as shown in FIG. 11A, in such a case that a platen gap (PG) is large, a distance measured from the nozzle forming surface 15*a* up to the ink absorbing material 24 is also large. In such a case that an ink amount of one dot (will also be referred to as a "dot weight" hereinafter) during the flushing operation, a degree at which ink droplets which are jetted from a nozzle may become mist before being reached to the ink absorbing material 24 is increased (large occurrence of mist of FIG. 11A).

Figure 11B:
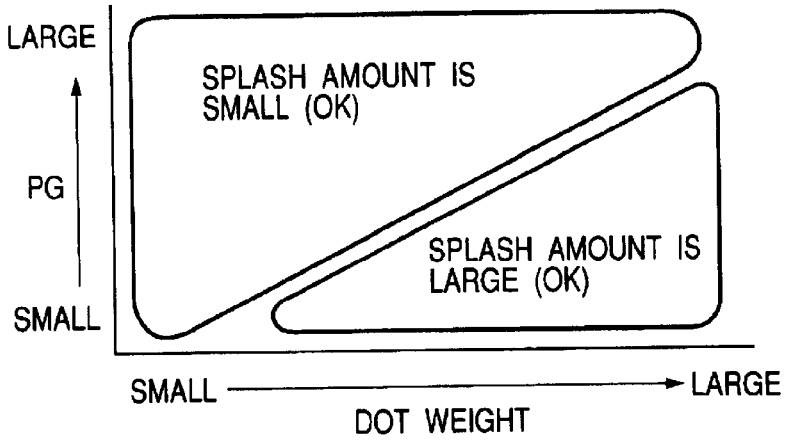

Also, while the platen gap (PG) is made small, in such a case that the dot weight during the flushing operation is controlled to be increased, when ink droplets jetted from a nozzle are reached to the ink absorbing material 24, splash of such ink droplets will occur. Thus, splash of these ink droplets may break meniscus of ink, which is formed in a nozzle opening, so that a degree at which a print failure is induced is increased (splash amount is increased in FIG. 11B).

Figure 11C:
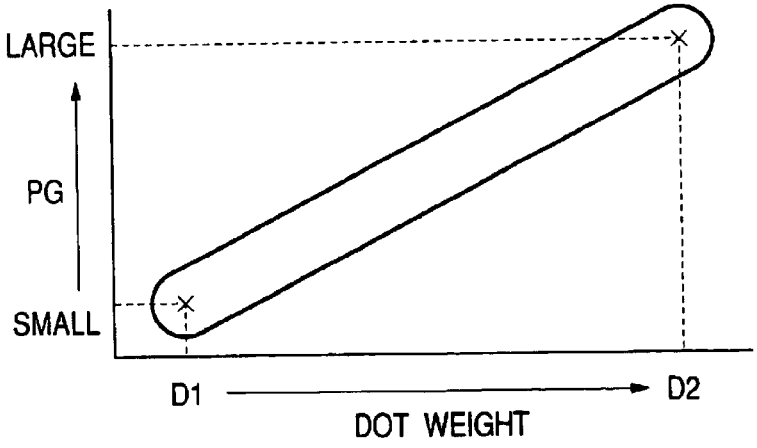

Under such a circumstance, based upon the above-described correlative relationship, such a control operation is carried out. That is, as indicated in FIG. 11C, while the platen gap is increased, the weight of one dot of the ink droplet based on the flushing operation is increased. As a consequence, the degree of contamination caused by the occurrence of the ink mist is reduced, and also, the degree of splash of the ink droplets at the ink absorbing material is reduced, so that the occurrence of the print failure can be suppressed.

As previously explained, while the flushing operation is carried out, it is so effective that the weight of one dot of the ink droplets is controlled in accordance with the dimension of the platen gap. In this case, the purpose of the above-described flushing operation is given as follows. That is, while the printing operation is carried out, a thickened ink which is located in the vicinity of such a nozzle opening contained in such a recording head and rarely jetted is regularly jetted to be disposed in a flushing area. As a result, the printing operation is performed by employing ink under such a condition that viscosity thereof is not increased. As a consequence, a total amount of such ink which should be jetted in a single flushing step is not changed in response to a platen gap.

Therefore, in such a case that an ink amount which should be jetted in a single flushing step is equal to X (g), assuming now that a flushing dot weight when a flushing gap is small is equal to D1 (g) and also a flushing dot weight when a flushing gap is large is equal to D2 (g), the below-mentioned control operation is preferably carried out in such a manner that a total jetting number (also, will be referred to as a "shot number") when the platen gap is small is set to X/D1, and further, a flushing shot number when the platen gap is large is set to X/D2.

In other words, in the case that adjustment information of the platen gap adjuster indicates such a fact that the platen gap is large, a time duration required in the flushing step can be shortened by controlling to reduce a total shot number of the ink droplets which are jetted from the recording head within a single flushing step, as compared with such a case that the adjustment information indicates that the platen gap is small. It should be understood that the foregoing description is made based upon such an initial condition of employing the total ink amount which is jetted by all of the nozzles formed in the recording head. When this total ink amount is converted into a total ink amount per one nozzle, this total ink amount is equal to such a value calculated by dividing the above-explained X/D1 and X/D2 by a total nozzle number.

The previously explained circuit arrangement shown in FIG. 6 may be similarly used as such a control circuit capable of controlling both the flushing dot weight and the flushing shot number under optimum conditions in response to the above-described platen gap. Since the partial functions realized in the circuit arrangement shown in FIG. 6 are different from those of this recording apparatus of the second embodiment, both functions and operations of the respective blocks corresponding to this recording apparatus of the second embodiment will now be explained although these functions and operations are partially repeated in the following description.

Reference numeral 61 shown in FIG. 6 indicates a print control unit. This print control unit 61 produces bit map data based upon print data supplied from a host computer (not shown), and is provided with the following function. That is, in accordance with this bit map data, a drive signal is generated from a head drive means 62 so as to jet ink droplets from the recording head 15 mounted on the carriage 1. This head drive means 62 is also arranged in such a way that another drive signal for a flushing operation is outputted to the recording head 15 by receiving the drive signal generated based upon the print data and also by receiving a flushing instruction signal supplied from a flushing control unit 63.

Reference numeral 64 indicates a cleaning control unit. This cleaning control unit 64 is provided with a function capable of executing a cleaning operation in response to an instruction signal supplied from a cleaning instruction sensing unit 66 which receives, for example, an ON-instruction of a cleaning instruction switch 65 arranged on an operation panel. Also, this cleaning control unit 64 is equipped with a function capable of similarly executing the cleaning operation also in the case that this cleaning control unit 64 receives a cleaning instruction through the print control unit 61 from the above-explained host computer.

The cleaning control unit 64 is equipped with another function. That is, when the cleaning instruction is received, this cleaning control unit 64 controls a pump drive means 67 so as to drive the suction pump 10. Then, since the suction pump 10 is driven, negative pressure is applied to an internal space of the capping device 9, so that the ink is sucked/ejected from the nozzle openings of the recording head 15. Also, under such a condition that sealing of the nozzle forming surface 15*a* by the capping device 9 is released, the cleaning control unit 64 again drives the suction pump 10, so that the wasted ink which is ejected into the internal space of the capping device 9 can be disposed into the wasted ink tank 12.

On the other hand, this recording apparatus is arranged in such a manner that a control signal is sent out from the above-described print control unit 61 with respect to the flushing timer 71. This flushing timer 71 is operated as follows. For instance, while a printing operation is carried out, when such a printing operation is continued for a predetermined time duration (namely, 10 seconds in this embodiment), the flushing timer 71 sends out the control signal to the operation mode control unit 68. In other words, this flushing timer 71 owns such a function capable of executing a function of the above-described flushing requirement judging step. Upon receipt of the control signal supplied from the flushing timer 71, the operation mode control unit 68 supplies a control signal to the carriage motor control unit 69 so as to perform such an operation that the carriage 1 is transported to the flushing position.

In this case, the recording apparatus is so arranged that a signal derived from an encoder 70 is supplied to the operation mode control unit 68. This encoder 70 owns such a function capable of, for example, optically sensing the moving position of the carriage 1. To this end, although not shown in this drawing, while a large number of optical slits are arranged along the move direction of the carriage 1, the moving position of the carriage 1 can be detected by counting up a total interruption number of such light which may pass through the respective slots in accordance with the scanning operation of the carriage 1.

With employment of this arrangement, in such a case that the operation mode control unit 68 receives an instruction of flushing operation supplied from the flushing timer 71, this operation mode control unit 68 sends a control signal to a carriage motor control unit 69 with reference to a positional signal derived from the encoder 70. Then, since the drive operation of the carriage motor 2 is controlled, the capping device 9 may lift up toward the nozzle forming surface 15*a* of the recording head 15 mounted on the carriage 1, and then, as indicated in FIG. 10, this capping device 9 is located opposite to the nozzle forming surface 15*a* under such a condition that a predetermined interval is kept between them.

On the other hand, information of the platen gap is supplied from a platen gap detecting unit 72 to the operation mode control unit 68. In this embodiment, such binary information for indicating as to whether the platen gap is large, or small is supplied to the operation mode control unit 68. As a consequence, depending upon the manipulation position of the operation lever 52 shown in FIG. 5, for example, a microswitch (not shown in this drawing) is ON/OFF-controlled, and thus, a binary signal which is produced based upon the information derived from this microswitch is supplied to the operation mode control unit 68.

Then, the above-described operation mode control unit 68 sets a weight of ink droplets during the flushing operation based upon a binary signal which is obtained from information 69 of this platen gap. In other words, this operation mode control unit 68 may realize a function of the above-described ink amount setting step. Also, the operation mode control unit 68 sets a total shot number of ink droplets which are jetted from the respective nozzles in response to the binary signal derived from the information 69 of this platen gap.

Then, as described above, when the control signal is sent from the flushing timer 7 with respect to the operation mode control unit 68, this operation control unit 68 sends a control signal to the flushing control unit 63. In response to this control signal, a flushing control signal is sent out from the flushing control unit 63 with respect to the head drive means 62, so that a flushing step is carried out.

In this case, when the platen gap is large, as one example, it is so controlled that the flushing dot weight is set to 19.5 ng/1 shot, and a total shot number at this time becomes equal to 96 shots/1 nozzle. Also, when the platen gap is small, it is so controlled that the flushing dot weight is set to 13 ng/1 shot, and a total shot number at this time becomes equal to 144 shots/1 nozzle.

In the above-described recording apparatus of the second embodiment, the microswitch is utilized so as to acquire the information with respect to the dimensions of the platen gaps, while this microswitch is ON/OFF-controlled in accordance with the manipulation position of the operation lever 52 shown in FIG. 5. The above-described sufficiently practical functions may be obtained even when such binary information of the microswitch is utilized. Alternatively, for instance, information derived from a rotary encoder may be utilized, while a linear electric signal is obtained in response to a pivot angle of the operation lever 52 shown in FIG. 5. In this alternative case, both the above-described flushing dot weight and the total jetting number of the ink droplets may be controlled in multiple stages in response to an adjusting degree of the platen gap.

Also, the above-described recording apparatus of the second embodiment is so arranged that the ink droplets which are jetted from the recording head by executing the flushing operation are received by the capping device. Alternatively, a similar operation effect may be apparently achieved by a recording apparatus constructed in such a manner that while a flushing area is formed on a scanning path of the recording head, the flushing operation is carried out at this scanning place.

As apparent from the above-described descriptions, in accordance with the ink jet recording apparatus of the first embodiment, which employs the moving position control method for the capping device, according to the present invention, the positional adjustment of the capping device moved to the flushing position is carried out in response to the adjustment amount of the platen gap. As a consequence, the flushing a operation can be carried out while maintaining the optimum interval between the recording head and the capping device. Also, in such a case that the nozzle forming surface of the recording head is capped by the capping device, since the positional adjustment of the capping device is carried out in response to the adjustment amount of the platen gap, the nozzle forming surface can be capped under substantially constant abutting pressure.

Also, in accordance with the ink jet recording apparatus of the second embodiment, which employs the flushing control method, according to the present invention, the flushing control operation is carried out in such a manner that the ink jetting amount of one dot during the flushing operation is adjusted in response to the dimension of the platen gap. As a consequence, the occurrence degree of ink mist during the flushing operation can be effectively reduced, and also, such a degree that the ink droplets rebounds to the recording head, which causes the print failure, can be effectively reduced.

In addition, since the recording apparatus is constituted by controlling the total jetting number of the ink droplets during the flushing operation in response to the dimension of the platen gap, the purpose of this flushing operation can be sufficiently achieved. Moreover, such an ink jet recording apparatus can be provided, by which lowering of the throughput caused by the flushing operation can be suppressed.

What is claimed is:

1. An ink jet recording apparatus comprising:

an ink jet recording head mounted on a carriage for jetting ink droplets in accordance with print data; and a capping device for capping a nozzle forming surface of the recording head;

wherein when the carriage is moved to a mount portion where the capping device is mounted, the capping device is moved toward the nozzle forming surface of the recording head by receiving a driving force which moves the carriage, so that the capping device caps the nozzle forming surface; and a stopping position of the carriage in the mount portion of the capping device is adjusted based on adjustment information of a platen gap adjuster.

2. An ink jet recording apparatus according to claim 1, the capping device including a slider which is moved toward the recording head by receiving at least the driving force which moves the carriage, and a cap member mounted on the slider for capping the nozzle forming surface of the recording head, wherein when the carriage is moved, the driving force which moves the carriage is transmitted from a side of the carriage to a side of the slider through a driving force transmitting device which abuts against the slider.

3. An ink jet recording apparatus according to claim 2, wherein the slider is moved toward the recording head being attached to a link arm rotatably mounted on a frame by receiving the driving force of the carriage through the driving force transmitting device; and a guide projection formed on the slider is slid along a guide groove formed in the frame in an inclined manner, whereby the slider is moved toward the recording head.

4. An ink jet recording apparatus according to claim 3, further comprising:

a regulating device for retaining the guide projection formed on the slider at a predetermined position in the guide groove based on the adjustment information of the platen gap adjuster.

5. An ink jet recording apparatus according to claim 3 wherein the ink jet recording apparatus is arranged in such a manner that a regulating operation for retaining the guide projection at a predetermined position in the guide groove is performed by stopping a drive operation of a carriage motor for moving the carriage in the reciprocation motion.

6. An ink jet recording apparatus according to claim 2, wherein a spring member is interposed between the slider and the cap member; and the cap member abuts against the nozzle forming surface of the recording head by receiving a urging force of the spring member in a state that the nozzle forming surface is capped by the capping device.

7. An ink jet recording apparatus according to claim 1, wherein a flushing position where the capping device is located opposite to the nozzle forming surface of the recording head with a predetermined interval and a capping position where a nozzle forming surface of the recording head is capped by the capping device, are set based on adjustment information of the platen gap adjuster.

8. An ink jet recording apparatus according to claim 7, wherein in the case that the adjustment information of the platen gap adjuster indicates that a platen gap is small, the guide projection formed on the slider is regulated to be retained at a lower position within the guide groove formed in the frame under inclined condition at each of the flushing position and the capping position, as compared with such a case that the adjustment information of the platen gap adjuster indicates that a platen gap is large.

9. A moving position control method of a capping device adapted to an ink jet recording apparatus comprising an ink jet recording head mounted on a carriage for jetting ink droplets in accordance with print data, and the capping device capable of capping a nozzle forming surface of the recording head, wherein when the carriage is moved to a mount portion where the capping device is mounted, the capping device is moved toward the nozzle forming surface of the recording head by receiving driving force of the carriage, the moving position control method comprising the steps of:

judging a flushing requirement as to whether or not the flushing operation is required;

acquiring a platen gap adjustment information from a platen gap adjuster if the flushing operation is required;

adjusting an interval between the nozzle forming surface of the recording head and the capping device at a flushing position by controlling the moving position of the carriage to a mount portion of the capping device based on the platen gap adjustment information; and flushing ink droplets from the recording head into the capping device, while maintaining the interval.

10. A moving position control method according to claim 9 wherein a judgement of the flushing requirement is started based on a time counting operation of a flushing timer which is managed while print operation of the recording apparatus is carried out.

11. A moving position control method of a capping device adapted to an ink jet recording apparatus comprising an ink jet recording head mounted on a carriage for jetting ink droplets in accordance with print data and a capping device for capping a nozzle forming surface of the recording head, wherein when the carriage is moved to a mount portion where the capping device is mounted, the capping device is moved toward the nozzle forming surface of the recording head by receiving driving force of the carriage, the moving position control method comprising the steps of:

judging a capping requirement as to whether or not the ink jet recording head is required to be advanced to a capping condition;

acquiring a platen gap adjustment information from a platen gap adjuster if the capping operation is required; and controlling the moving position of the carriage to a mount portion of the capping device based upon the platen gap adjustment information.

12. An ink jet recording apparatus comprising:

an ink jet recording head mounted on a carriage for jetting ink droplets in accordance with print data; and flushing control unit for moving the recording head to a flushing area and for applying a drive signal irrespective of a printing operation to the recording head so as to flush ink droplets into the flushing area;

wherein when a flushing operation is carried out in the flushing area, the flushing control unit adjusts an ink jetting amount of one dot during the flushing operation based upon adjustment information of a platen gap adjuster.

13. An ink jet recording apparatus according to claim 12, wherein in a case that the adjustment information of the platen gap adjuster indicates that a platen gap is large, the flushing control unit increases the ink amount of one dot which is jetted while the flushing operation is carried out, as compared with that of such a case that the adjustment information of the platen gap adjuster indicates that the platen gap is small.

14. An ink jet recording apparatus according to claim 13, wherein in the case that the adjustment information of the platen gap adjuster indicates that a platen gap is large, the flushing control unit decreases a total number of ink droplets which are jetted from the recording head while a single flushing step is carried out, as compared with that of such a case that the adjustment information of the platen gap adjuster indicates that the platen gap is small.

15. An ink jet recording apparatus according to claim 12, wherein the ink droplets jetted from the recording head by executing the flushing operation are received by capping a nozzle forming surface of the recording head.

16. A flushing control method executed in an ink jet recording apparatus comprising an ink jet recording head mounted on a carriage transported in a reciprocation motion, for jetting ink droplets in accordance with print data and flushing control unit for moving the recording head to a flushing area and for applying a drive signal irrespective of a printing operation to the recording head so as to flush ink droplets into the flushing area, the flushing control method comprising the steps of:

a flushing requirement judging step for judging as to whether or not the flushing operation is required;

an ink amount setting step for setting an ink jetting amount of one dot during a flushing operation based on platen gap adjustment information in such a case that the flushing requirement judging step judges that the flushing operation is required; and a flushing step for flushing ink droplets with respect to a flushing area based upon the ink jetting amount of one dot which is set in the ink amount setting step.

17. A flushing control method according to claim 16, wherein in the case that the ink jetting amount of one dot during the flushing operation is set in the ink amount setting step, a total number of ink droplets which are jetted from the recording head within a single flushing step is set at the same time.

18. A flushing control method according to claim 16, wherein the flushing requirement judging step is carried out based upon a time counting operation of a flushing timer which is managed while print operation of the recording apparatus is carried out.

* * * * *